US006363628B1

(12) United States Patent
Mahon et al.

(10) Patent No.: US 6,363,628 B1
(45) Date of Patent: Apr. 2, 2002

(54) ERGONOMIC SNOW SHOE BINDING AND METHOD OF MAKING THE SAME

(76) Inventors: Terrence K. Mahon, 606 E. Beaumont Ave., Whitefish Bay, WI (US) 53217; Daniel A. Matre, 2343 N. 81st St., Wauwatosa, WI (US) 53213

( * ) Notice: Subject to any disclaimer, the term of this patent is extended or adjusted under 35 U.S.C. 154(b) by 0 days.

(21) Appl. No.: 09/476,683

(22) Filed: Dec. 30, 1999

(51) Int. Cl.[7] ..... A43B 5/04; A43B 5/16
(52) U.S. Cl. ..... 36/122; 36/123; 36/125
(58) Field of Search ..... 36/122, 123, 124, 36/125, 116

(56) References Cited

U.S. PATENT DOCUMENTS 3,744,162 A * 7/1973 Beck ..... 36/122
5,253,437 A * 10/1993 Klebahn et al. ..... 36/122
5,540,002 A * 7/1996 Liautaud ..... 36/122
5,740,621 A * 4/1998 Wing et al. ..... 36/122
5,809,668 A * 9/1998 Kiniry et al. ..... 36/122
5,983,532 A * 11/1999 McGrath et al. ..... 36/125
6,092,312 A * 7/2000 Neidhardt ..... 36/124
6,155,998 A * 12/2000 Gilmour ..... 602/27

* cited by examiner

*Primary Examiner*—Paul T. Sewell
*Assistant Examiner*—Jila Mohandesi
(74) *Attorney, Agent, or Firm*—Boyle, Fredrickson, Newholm, Stein & Gratz, S.C.

(57) ABSTRACT

An improved binding for use with snowshoes and like sport apparatus is disclosed which employs a novel mounting arrangement similar to the calcanean wrapping technique used by athletic trainers to wrap the ankles of athletes, thereby resulting in an ambidextrous binding which comfortably and securely fits a wide variety of sizes of feet in an ergonomic manner while enhancing the performance of both the binding and the snowshoe to which it is attached. The binding has left and right side members pivotally mounted on a base member between the front and an intermediate longitudinal position thereupon, and left and right calcanean wrap members pivotally mounted on the base member near the rear thereof. A first set of straps overlies the side member and the calcanean wrap member on the left side are encircles the right side of the calcaneus of the foot of a wearer, and a second set of straps overlies the side member and the calcanean wrap member on the right side are encircles the left side of the calcaneus of the foot of a wearer.

31 Claims, 10 Drawing Sheets

56
58
46
54
44
42
48
50
40

42
52
46
44
40

46
52
44
40

52
48
42
46
40
44
50

52
46
42
44
48
50
40

ERGONOMIC SNOW SHOE BINDING AND METHOD OF MAKING THE SAME

BACKGROUND OF THE INVENTION

Field of the Invention

The present invention relates generally to bindings for use with snowshoes and the like to maintain the snowshoes on the feet of the wearer, and more particularly to an improved snowshoe binding which employs a novel mounting arrangement similar to the calcanean wrapping technique used by athletic trainers to wrap the ankles of athletes, thereby resulting in an ambidextrous binding which comfortably and securely fits a wide variety of sizes of feet in an ergonomic manner while enhancing the performance of both the binding and the snowshoe to which it is attached.

Recent years have seen an explosion in the level of interest in snowshoeing, with a broad cross-section of the public realizing that for a relatively modest investment, they can strap on a pair of snowshoes and immediately begin to snowshoe with a degree of proficiency not immediately available in either cross-country or downhill skiing. Rather than requiring an extended learning curve, new participants in the sport of snowshoeing have only to strap a pair of snowshoes on their feet, and then walk on the snow-covered ground. After only a few minutes, any initial clumsiness is quickly left behind, and the wearer is able to move with relative freedom off the beaten trail and in the middle of winter.

As might be expected, the increasing interest in snowshoeing has brought with it a widely expanding array of snowshoes from an increasing large number of manufacturers, many of which offer a variety of designs differing substantially from the traditional wood frames and leather or rawhide laced webbing. The problem associated with the traditional wood frame and leather laced webbing snowshoes is that they require a high degree of maintenance; if they are not properly and consistently maintained over time, they can be substantially less durable than is desirable. In addition, such traditional wood frame and leather laced webbing snowshoes are not at all inexpensive, due primarily to the large amount of hand work involved in weaving the leather webbing during the construction of these snowshoes.

Thus, over the last several years, the design of snowshoes have evolved rapidly from the traditional wood frame and leather laced webbing snowshoes to lightweight aluminum alloy tubular frames with a segments of synthetic man-made fabric stretched thereupon and secured by being riveted or laced to the tubular frames. The frames may be made of aircraft quality aluminum tubing which is bent to the desired outline, and which then has one end having a reduced outer diameter inserted into the other end to form a continuous perimeter. The aluminum frames may be anodized or electrostatically powder coated. The fabric, which is referred to as "decking," may be made of a manmade material such as nylon, or from woven and coated (laminated) manmade materials. The decking is stretched over the tubular frame and is either riveted in place on the frame or is laced to the frame. Other materials which have been used for snowshoes include molded plastics instead of sheet or fabric decking and carbon fiber frames instead of wood or aluminum.

With the advent of decking made of manmade fabric came the need to facilitate traction of the snowshoe, since the smooth surface of the decking does not have the friction afforded by the leather laced webbing of traditional snowshoes. Accordingly, modern snowshoes use a metal cleat or claw attached to the base of the binding and, optionally, under the portion of the decking which the heel of the wearer overlies. Such cleats, claws, or other traction devices are a necessity, especially on hard packed snow or ice.

The other major component of snowshoes is the binding, which functions both to retain the wearer's foot on the snowshoe and also as a hinge to allow the wearer to walk in a natural manner while wearing the snowshoes with the plane of the snowshoe being allowed to articulate rather than being forced to conform to the plane of the wearer's foot. For the most part, improvements made to snowshoe design have focused on the snowshoe itself rather than on the binding, with the result being that while snowshoes of today bear little resemblance to the traditional wood frame and leather laced webbing designs, the bindings on modern snowshoes have improved relatively little over time.

In fact, there have been only two major improvements to snowshoe binding design, both of which focus solely on the hinge aspect of bindings rather than on the mounting aspect. The first of these improvements is that the hinge is now typically biased into a neutral position with the binding being mounted on a strap made of manmade material such as extruded or die-cut PVC-coated vinyl, which allows the binding (and with it the foot of the wearer) to flex forward and backward. Thus, the binding is initially free to pivot, with greater rotation progressively increasing the amount of force opposing the rotation. This is referred to as a "fixed rotation" binding, and it results in an improved degree of articulation which facilitates a normal walking motion. It also lifts the snowshoe out of the snow with each step, facilitating walking in deep snow. In contrast, "free rotation" bindings, which are typically bearing-mounted on a rod extending between the sides of the snowshoe, let the tail of the snowshoe drag, which can make them less maneuverable and make walking backwards in powder nearly impossible.

The second of these improvements is a pivot system which combines the best features of a free rotation binding with the best features of a fixed rotation binding, as taught in U.S. Pat. No. 5,517,772, to Anderson. The '722 patent describes an adjustable system having a limited amount of initial freedom of rotation, with greater rotation being possible with the exertion of sufficient force to overcome a frictional force which is adjustable. U.S. Pat. No. 5,517,772 is hereby incorporated herein by reference.

With the exception of these two improvements, which both relate to the pivoting aspect of snowshoe bindings, the basic mounting technique employed by snowshoes has not markedly changed at all. Snowshoe bindings all retain the foot of the wearer on the snowshoe by first retaining the toe of the wearer's boot in the binding, and then by preventing the foot of the wearer from being moved rearwardly out of the binding. Thus, most snowshoe bindings use straps (typically two straps are used) to retain the toe of the wearer's boot in the binding, and an additional strap around the rear of the wearer's boot to hold prevent the toe of the boot from being withdrawn from the toe straps.

The '722 patent uses a variation of this technique, with a toe piece secured to winged panels which are laced around the toe of the boot of the wearer. Other bindings known in the art use toe pieces of fixed design or which are buckled or laced around the toe of the wearer's boot. All of them also include a strap or like apparatus around the back of the wearer's boot to prevent the boot from slipping out of the binding. These retaining straps are typically buckled in the back of the wearer's boot. Straps and buckles do not evenly distribute the forces they exert on the foot, typically causing discomfort to the foot of the wearer.

It is accordingly the primary objective of the present invention that it provide an improved binding for use in securing a snowshoe to the boot of the wearer in a manner which is both secure and comfortable, and which affords complete control over the snowshoe on which the binding is mounted. It is a closely related objective that the improved binding of the present invention hold the wearer's boot securely in place when attached, keeping front to back, lateral, and rotational foot slippage to a minimum such that the binding of the present invention acts as an extension of the foot. It is another objective of the binding of the present invention that it distribute forces evenly, such that clamping and compressive loads are evenly distributed about the entire area of the wearer's foot in an ergonomic fashion emulating the muscular system of the foot.

It is an additional objective of the binding of the present invention that it be easy to operate, even while wearing gloves or mittens, and that the securing mechanism be located where it is easily accessible on the side and/or the top of the foot rather than behind the foot. It is a further objective of the binding of the present invention that it be quick to secure and that it require only a single step to both adjust it and secure it, making it very simple to use. It is yet another objective of the binding of the present invention that once it has been fastened to the foot, it stay secured and properly adjusted until it is removed.

It is still another objective of the binding of the present invention that it accommodate a wide variety of sizes of foot and any type of boot or shoe, or even stockings or bare feet for applications beyond use as a snowshoe binding, thereby minimizing or entirely eliminating the requirement for different size bindings to accommodate different wearers. It is a further objective of the binding of the present invention that it be of an ambidextrous design, to thereby fit either foot without requiring different left and right binding designs. It is a still further objective of the binding of the present invention that it allow for use with either a fixed rotation or a free rotation mounting system, or with the hybrid arrangement of the above incorporated by reference '722 patent.

The binding of the present invention must also be of construction which is both durable and long lasting, and it should also require little or no maintenance to be provided by the user throughout its operating lifetime. In order to enhance the market appeal of the binding of the present invention, it should also be of inexpensive construction to thereby afford it the broadest possible market. Finally, it is also an objective that all of the aforesaid advantages and objectives of the binding of the present invention be achieved without incurring any substantial relative disadvantage.

SUMMARY OF THE INVENTION

The disadvantages and limitations of the background art discussed above are overcome by the present invention. With this invention, a binding design suitable for use with snowshoes is described which is of an ergonomic design similar to the calcanean wrapping technique used by athletic trainers to wrap the ankles of athletes, thereby resulting in an ambidextrous binding which comfortably and securely fits a wide variety of sizes of feet in an ergonomic manner while enhancing the performance of both the binding and the snowshoe to which it is attached. The binding of the present invention thus integrates lateral, longitudinal, and rotational or torsional clamping action using the calcanean wrapping technique.

The ergonomic snowshoe binding of the present invention has as its base a binding chassis which is made of metal which will support the portions of the wearer's foot from roughly the arch of the foot forward, and is made with an acute upward angle therein to better fit the configuration of this portion of the wearer's foot. Located on top of the binding chassis is a foot pad, which provides a frictional surface for the wearer's foot to rest upon. Six pivot points are located in the binding chassis and are aligned with apertures in the foot pad, with three pivot points being located on each of the left and right sides of the pivot plate at positions near the front of the binding chassis (front pivot points), near the rear of the chassis (rear pivot points), and at a third location roughly three-quarters of the way between the front and the rear of the binding chassis (intermediate pivot points).

Left and right Y-shaped side members and left and right L-shaped calcaneous wrap members are used to distribute the forces of two sets of straps which retain the ergonomic snowshoe binding of the present invention in place on the foot of a wearer. The Y-shaped side members each are connected at one of the arms of the Y to a front pivot point, and at the other one of the arms of the Y to an intermediate pivot point such that the left and right Y-shaped side members are respectively mounted on the left and right sides of the binding chassis and foot pad, in an inverted position.

Left and right looping straps are each respectively arranged in an inverted V-shaped position on the outside of the left and right Y-shaped side members, respectively, with the ends of the looping straps lying intermediate the Y-shaped side members and the foot pad at the pivot points, with rivets being used to secure the arms of the Y's of the Y-shaped side members and the ends of the looping straps to the binding chassis in a manner permitting rotational movement of the tops of the arms of the Y's of the Y-shaped side members and the ends of the looping straps to provide an enhanced accommodation for different wearer foot sizes. Left and right connecting straps are respectively connected to the midpoints of the left and right looping straps, respectively, with slip rings. The other ends of the connecting straps extend through integral retaining loops located on the outside of the Y-shaped side members near the bases of the legs of the Y's, and are connected to buckles.

The L-shaped calcaneous wrap members each are connected at the top of the leg of the L to a rear pivot point, such that the left and right L-shaped calcaneous wrap members are respectively mounted on the left and right sides of the binding chassis and foot pad, in an inverted position with the free end of the base of the L directed toward the front of the binding chassis. Long left and right cinch straps each are located with one end lying intermediate the L-shaped calcaneous wrap members and the foot pad at the rear pivot points, with rivets being used to secure the top of the leg of the L of the L-shaped calcaneous wrap members and the ends of the cinch straps to the binding chassis in a manner permitting rotational movement of the tops of the legs of the L-shaped calcaneous wrap members and the ends of the cinch straps. The left and right cinch straps extend on the outside of the left and right L-shaped calcaneous wrap members, respectively, along the base of the L, with the free ends of the cinch straps being located on the outside of the L-shaped calcaneous wrap members and extending through with the ends of integral looping straps located on the outside of the L-shaped calcaneous wrap members at the bottoms of the legs of the L's.

When the foot of a wearer of the ergonomic snowshoe binding of the present invention is placed into the binding, the free ends of the cinch straps pass from the bottom of the legs of the L's of the L-shaped calcaneous wrap members around the back of the wearer's foot, through integral looping straps located on the outside of the L-shaped calcaneous wrap members at the bases of the L's, and are connected to a buckle. Thus, the left cinch strap passes from the bottom of the leg of the L of the left L-shaped calcaneous wrap members around the back of the wearer's foot, through the integral looping strap located on the outside of the right L-shaped calcaneous wrap members at the bases of the L, and is connected to the left buckle. Similarly, the right cinch strap passes from the bottom of the leg of the L of the right L-shaped calcaneous wrap members around the back of the wearer's foot, through the integral looping strap located on the outside of the left L-shaped calcaneous wrap members at the bases of the L, and is connected to the right buckle.

The ends of the Y-shaped side members and the L-shaped calcaneous wrap members which are connected to the binding chassis are connected pivotally, thereby allowing the Y-shaped side members and the L-shaped calcaneous wrap members to pivot to adapt to various foot sizes. The ergonomic snowshoe binding of the present invention is thus adaptable to comfortably fit wearers with foot sizes varying approximately from a woman's size 6 foot to a man's size 13 foot. In addition, the ergonomic snowshoe binding of the present invention is ambidextrous to allow its use interchangeably on either foot.

An Achilles strap is located at the back of the wearer's foot, with the cinch straps both passing through openings in the Achilles strap and acting to retain it in place. In the preferred embodiment, the Achilles strap is made of a segment of strap folded upon itself, with a loop extending upward from the point at which the cinch straps pass therethrough. The loop can be used to pull the cinch straps on the back of the wearer's foot when the wearer's foot is placed into the ergonomic snowshoe binding.

It will thus be appreciated by those skilled in the art that the straps form a calcanean wrap configuration, and that they are tightened by pulling the cinch straps rearwardly from the buckles, which are located at the sides of the wearer's foot near the front of the ankles. Optionally, cushioning pads may be installed on portions of the inside surfaces of the Y-shaped side members and the L-shaped calcaneous wrap members which bear against the wearer's foot. It will be appreciated by those skilled in the art that with or without the cushioning pads, the ergonomic snowshoe binding of the present invention distributes the forces of the straps evenly about the entire area of the wearer's foot in an ergonomic fashion with the calcanean wrap of the bindings emulating the muscular system of the foot. That is, the straps, Y-shaped side members, and L-shaped calcanean wrap members emulate and complement the muscles and tendons of the foot.

The ergonomic snowshoe binding of the present invention may be mounted onto the snowshoe in conventional style using either a fixed rotation or a free rotation mounting system, or with the hybrid arrangement of the above incorporated by reference '722 patent. In any of these techniques, the mounting apparatus is located under the binding chassis.

An additional component which can be used with the ergonomic snowshoe binding of the present invention is a rear claw, which is mounted onto the snowshoe decking on the bottom side thereof in a position immediately behind the location of the binding. A heel pad can be mounted on the top side of the snowshoe over the location of the rear claw, with the rear pad having a frictional surface upon which the wearer's heel will rest. The heel pad and the rear claw may be mounted to the decking of the snowshoe using rivets.

It may therefore be seen that the present invention teaches an improved binding for use in securing a snowshoe to the boot of the wearer in a manner which is both secure and comfortable, and which affords complete control over the snowshoe on which the binding is mounted. The improved binding of the present invention holds the wearer's boot securely in place when attached, and keeps front to back, lateral, and rotational foot slippage to a minimum such that the binding of the present invention acts as an extension of the foot. The binding of the present invention also distribute forces evenly, such that clamping and compressive loads are evenly distributed about the entire area of the wearer's foot in an ergonomic fashion emulating the muscular system of the foot.

The binding of the present invention is easy to operate, even while wearing gloves or mittens, and the securing mechanism is located where it is easily accessible on the side and/or the top of the foot rather than behind the foot. The binding of the present invention is quick to secure, and requires only a single step to both adjust it and secure it, making it very simple to use. Once the binding of the present invention has been fastened to the foot, it will stay secured and properly adjusted until it is removed.

The binding of the present invention accommodates a wide variety of sizes of foot and any type of boot or shoe, or even stockings or bare feet for applications beyond use as a snowshoe binding, thereby minimizing or entirely eliminating the requirement for different size bindings to accommodate different wearers. The binding of the present invention is of an ambidextrous design, thereby fitting either foot without requiring different left and right binding designs. The binding of the present invention allows for use with either a fixed rotation or a free rotation mounting system, or with the hybrid arrangement of the above incorporated by reference '722 patent.

The binding of the present invention is of a construction which is both durable and long lasting, and which will require little or no maintenance to be provided by the user throughout its operating lifetime. The binding of the present invention is also of inexpensive construction to enhance its market appeal and to thereby afford it the broadest possible market. Finally, all of the aforesaid advantages and objectives of the binding of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
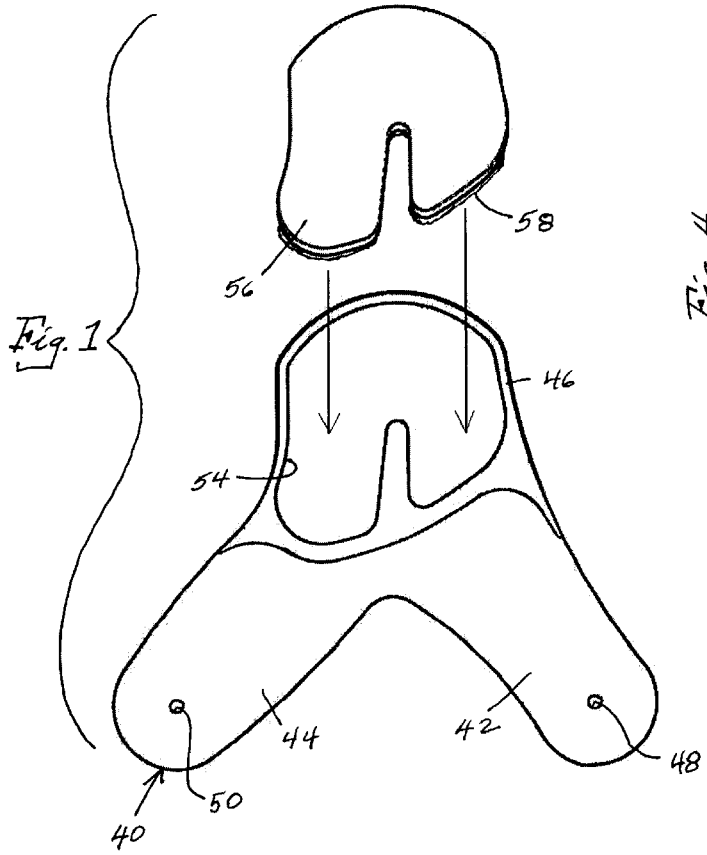
FIG. 1 is an exploded view showing the installation of a cushioning pad onto the inside of a Y-shaped side member on the leg of the Y, the Y-shaped side member being for placement on the left side of a wearer's foot.

The preferred embodiment uses pivotable mounting of Y-shaped side members and L-shaped calcaneous wrap members on the binding chassis to accommodate feet of different sizes, with a strap system overlying the Y-shaped side members and the L-shaped calcaneous wrap members. Thus, the heart of the ergonomic snowshoe binding of the present invention is these Y-shaped side members and L-shaped calcaneous wrap members and the strap system which interconnects them. The design and construction of the left side members is illustrated and described in detail herein, it being understood that the design and construction of the right side members is identical in principle, but with the right side members constituting mirror images of the left side members. In addition, similar reference numerals are used for the left and right side elements of the present invention throughout, but with the reference numerals used for the right side elements having 200 added to the reference numerals used for the left side elements.

Figure 4:
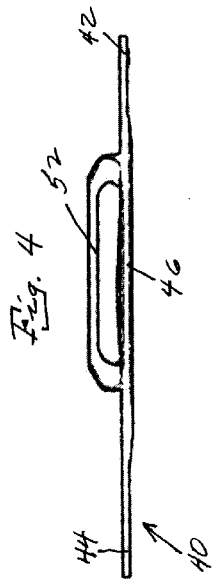
FIG. 4 is a second edge view of the Y-shaped side member illustrated in FIGS. 1 through 3, also showing the integral retaining loop on the outside of the Y-shaped member.
Figure 3:
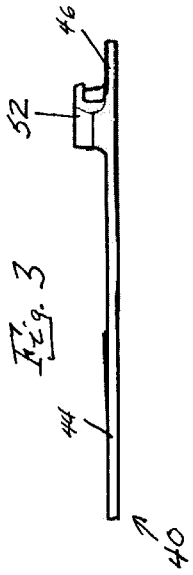
FIG. 3 is a first edge view of the Y-shaped side member illustrated in FIGS. 1 and 2, showing the interior of an integral retaining loop on the outside of the Y-shaped member.
Figure 5:
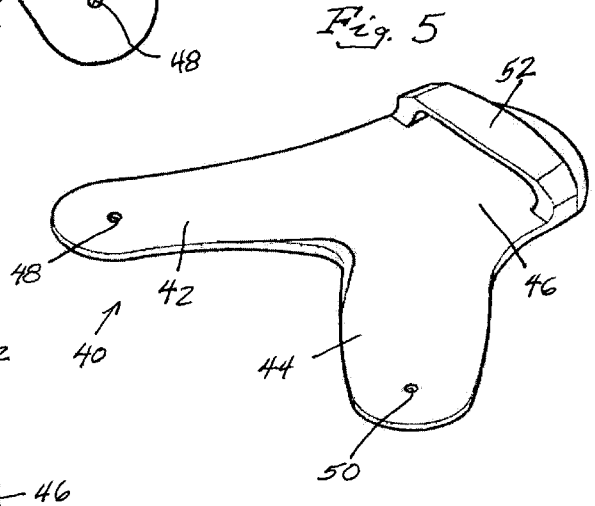
FIG. 5 is an isometric view of the Y-shaped side member illustrated in FIGS. 1 through 4.

Referring first to FIGS. 1 through 5, a left Y-shaped side member 40 is illustrated which has a configuration resembling an inverted Y having two arms 42 and 44 and a leg 46. The left Y-shaped side member 40 is relatively thin (as best shown in FIGS. 3 and 4), and, in the preferred embodiment, is approximately 5 inches tall and 5.8 inches wide, with the arms 42 and 44 of the Y being between approximately 1.3 and 1.7 inches wide, and the leg 46 of the Y being approximately 2.5 inches wide. The tops of the arms of the Y 42 and 44 (as seen in front or rear plan view) are rounded, as is the bottom of the leg 46 of the Y (as seen in front or rear plan view).

An aperture 48 is located in and extends through the arm 42 of the Y of the left Y-shaped side member 40 near the top of the arm 42 of the Y, and is concentric with the rounded top end of the arm 42 of the Y. An aperture 50 is located in and extends through the arm 44 of the Y of the left Y-shaped side member 40 near the top of the arm 44 of the Y, and is concentric with the rounded top end of the arm 44 of the Y.

Located on the outside of the left Y-shaped side member 40 on the leg 46 of the Y near the base thereof is an integral retaining loop 52 which extends nearly the entire width of the leg 46 of the Y. The integral retaining loop 52 thus defines a narrow space between itself and the surface of the left Y-shaped side member 40, as best shown in FIG. 4. A strap will extend through the integral retaining loop 52, as will become evident below when the assembly of the various elements of the ergonomic snowshoe binding of the present invention is described.

In the preferred embodiment, located in the inside of the left Y-shaped side member 40 on the leg 46 of the Y is a recessed area 54 for receiving a left side cushioning pad 56 which will fit partially therein. The left side cushioning pad 56 is thus thicker than the recessed area 54 is deep, so that when the left side cushioning pad 56 is installed in the recessed area 54, the left side cushioning pad 56 will project from the recessed area 54. The left side cushioning pad 56 is preferably secured by adhesive, which in the preferred embodiment is a two-sided adhesive film 58.

The left Y-shaped side member 40 is made of a flexible material which will remain flexible even in the cold environment which snowshoes are used in. In the preferred embodiment, the left Y-shaped side member 40 is made by injection molding of a thermoplastic elastomer (TPE) such as the material available from Monsanto Company under the trademark Santoprene®, and preferably is Santoprene® 101-90. The left side cushioning pad 56 is die cut from a sheet made of an appropriate resilient cushioning material, which in the preferred embodiment is a light but tough, resilient plastic foam material such as Ethylene Vinyl Acetate (EVA), which is a closed cell, cross-linked copolymer foam, and preferably is EVA 30.

Figure 8:
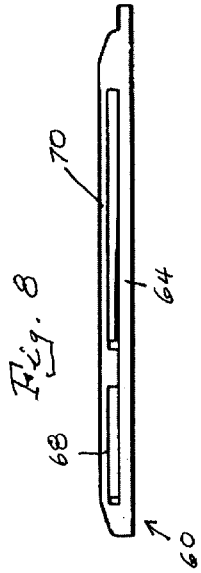
FIG. 8 is an edge view of L-shaped calcaneus wrap member illustrated in FIGS. 6 and 7, showing the interior of two integral retaining loops on the outside of the L-shaped calcaneus wrap member.
Figure 7:
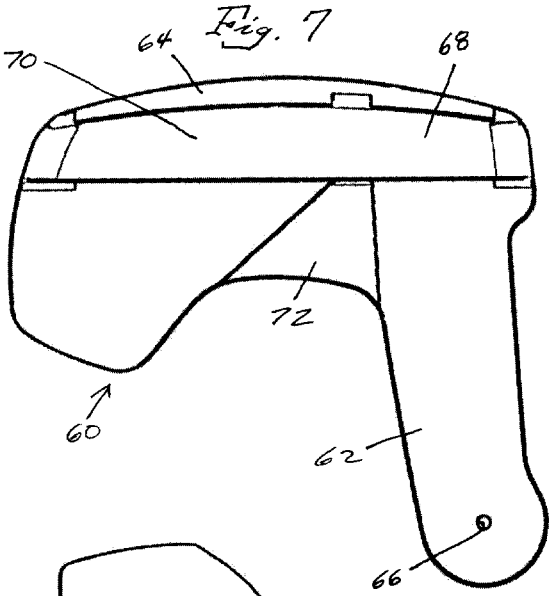
FIG. 7 is a plan view of the L-shaped calcaneus wrap member illustrated in FIG. 6 from the outside thereof.
Figure 9:
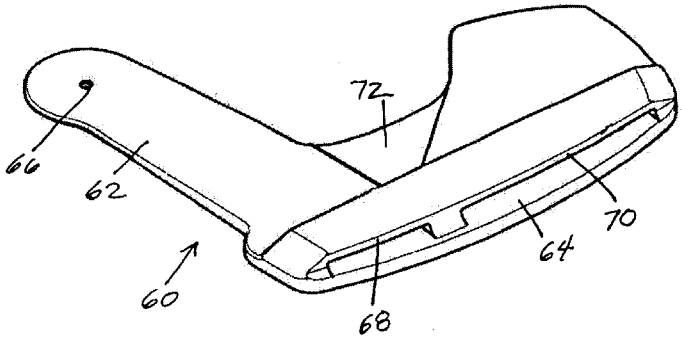
FIG. 9 is an isometric view of L-shaped calcaneus wrap member illustrated in FIGS. 6 through 8.

Referring next to FIGS. 6 through 9, a left L-shaped calcaneus wrap member 60 is illustrated which has a configuration resembling an inverted L having an leg 62 and a base 64. The base 64 of the L is curved slightly upwardly at the ends thereof, with the distal end of the base 64 of the L also extending upwardly somewhat. The left L-shaped calcaneus wrap member 60 is relatively thin (as best shown in FIG. 8), and, in the preferred embodiment, is approximately 5.4 inches tall and 5.8 inches wide, with the leg 62 of the L being between approximately 1.25 and 1.5 inches wide, and the base 64 of the L being approximately 2.1 inches wide except at the upwardly extending distal end, where it is between approximately 2.5 and 2.9 inches wide.

The top of the leg 62 of the L (as seen in front or rear plan view) is rounded. An aperture 66 is located in and extends through the leg 62 of the L of the left L-shaped calcaneus wrap member 60 near the top of the leg 62 of the L, and is concentric with the rounded top end of the leg 62 of the L. In addition, the leg 62 of the L is thinner near the top of the leg 62 of the L, and thicker near the bottom of the leg 62 of the L to facilitate the adaptation of the left L-shaped calcaneus wrap member 60 to the contour of the wearer's foot in the region of the calcaneus.

Located on the outside of the left L-shaped calcaneus wrap member 60 on the leg 62 of the L near the bottom thereof is an integral retaining loop 68 which extends essentially the width of the leg 62 of the L. The integral retaining loop 68 thus defines a narrow space between itself and the surface of the left L-shaped calcaneus wrap member 60, as best shown in FIG. 8.

Located on the outside of the left L-shaped calcaneus wrap member 60 on the base 64 of the L near the bottom thereof is an integral retaining loop 70 which extends from the integral retaining loop 68 to the distal end of the base 64 of the L. The integral retaining loop 70 thus defines a narrow space between itself and the surface of the left L-shaped calcaneus wrap member 60, as best shown in FIG. 8.

Located on the outside of the left L-shaped calcaneus wrap member 60 on the portion of the base 64 of the L adjacent the leg 62 of the L is a raised area 72, which varies in width from narrower adjacent the integral retaining loops 68 and 70, to wider at the top of the base 64 of the L. The narrower portion of the raised area 72 is located intermediate the integral retaining loop 68 and 70. Straps will extend through the integral retaining loops 68 and 70, as will become evident below when the assembly of the various elements of the ergonomic snowshoe binding of the present invention is described. The raised area 72 will act to guide the straps by acting as a perimeter on one side of the straps passing through the integral retaining loops 68 and 70.

In the preferred embodiment, located in the inside of the left L-shaped calcaneus wrap member 60 on the base 64 of the L is a recessed area 74 for receiving a left calcaneus cushioning pad 76 which will fit partially therein. The left calcaneus cushioning pad 76 is thus thicker than the recessed area 74 is deep, so that when the left calcaneus cushioning pad 76 is installed in the recessed area 74, the left calcaneus cushioning pad 76 will project from the recessed area 74. The left calcaneus cushioning pad 76 is preferably secured by adhesive, which in the preferred embodiment is a two-sided adhesive film 78.

The left L-shaped calcaneus wrap member 60 is made of a flexible material which will remain flexible even in the cold environment which snowshoes are used in. In the preferred embodiment, the left L-shaped calcaneus wrap member 60 is made by injection molding of a TPE such as the material available from Monsanto Company under the trademark Santoprene®, and preferably is Santoprene® 101-90. The left calcaneus cushioning pad 76 is die cut from a sheet made of an appropriate resilient cushioning material, which in the preferred embodiment is a light but tough, resilient plastic foam material such as EVA, and preferably is EVA 30.

Figure 10:
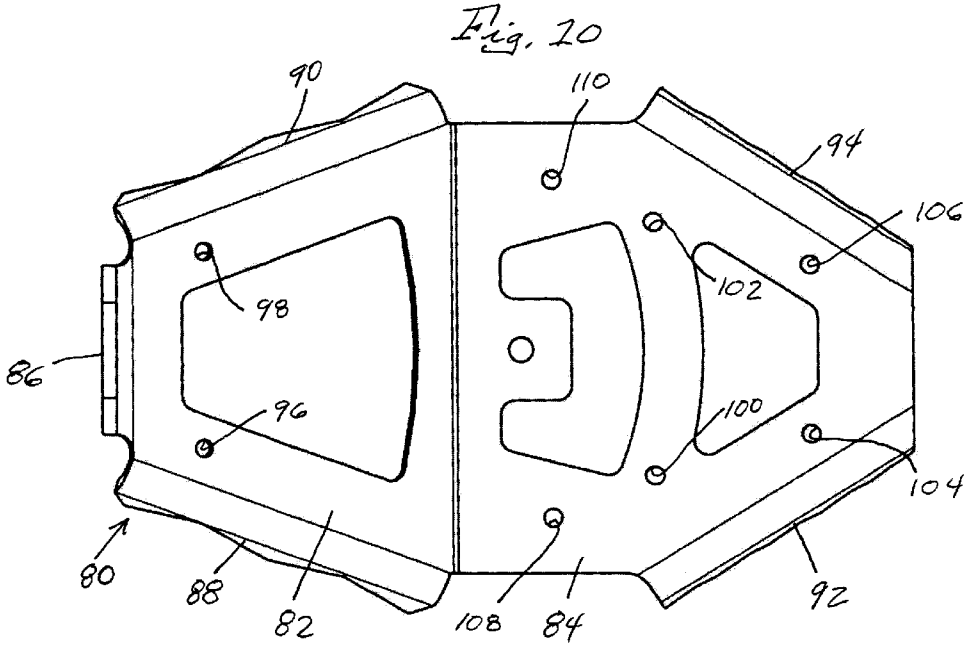
FIG. 10 is a top plan view of a binding chassis having claw portions extending downwardly therefrom.
Figure 11:
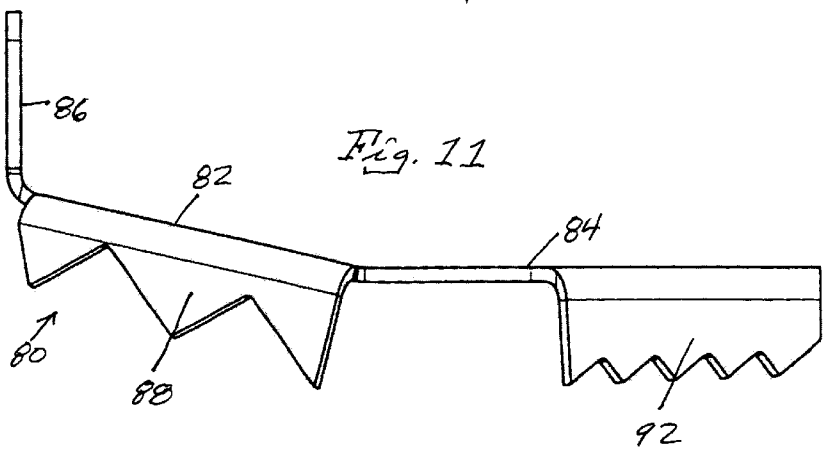
FIG. 11 is a first side view of the binding chassis illustrated in FIG. 10 from the left side thereof, showing the claw portions on the left side thereof.
Figure 12:
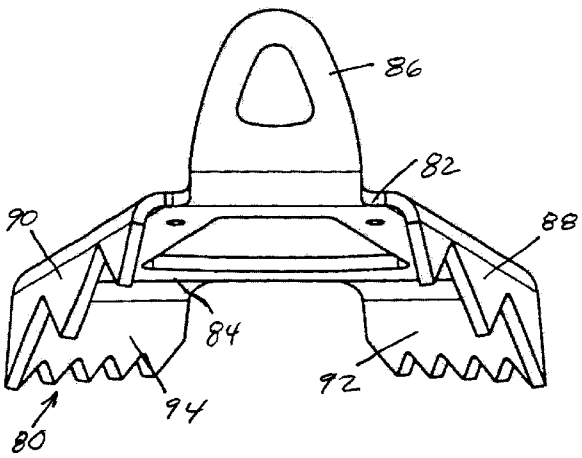
FIG. 12 is a second side view of the binding chassis illustrated in FIGS. 10 and 11 from the front thereof, showing the claw portions extending downwardly therefrom.
Figure 13:
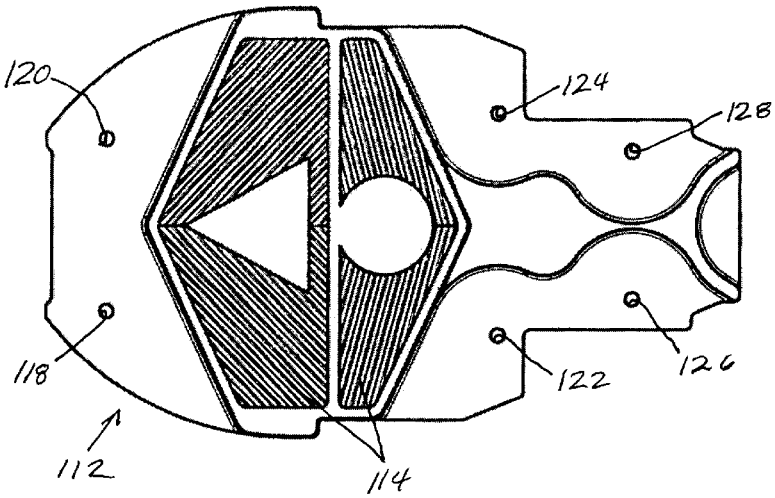
FIG. 13 is a top plan view of a foot pad.
Figure 15:
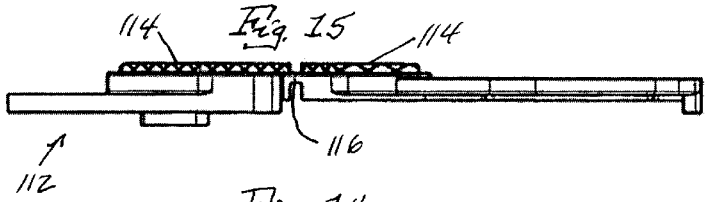
FIG. 15 is a first side view of the foot pad illustrated in FIGS. 13 and 14 from the left side thereof.
Figure 14:
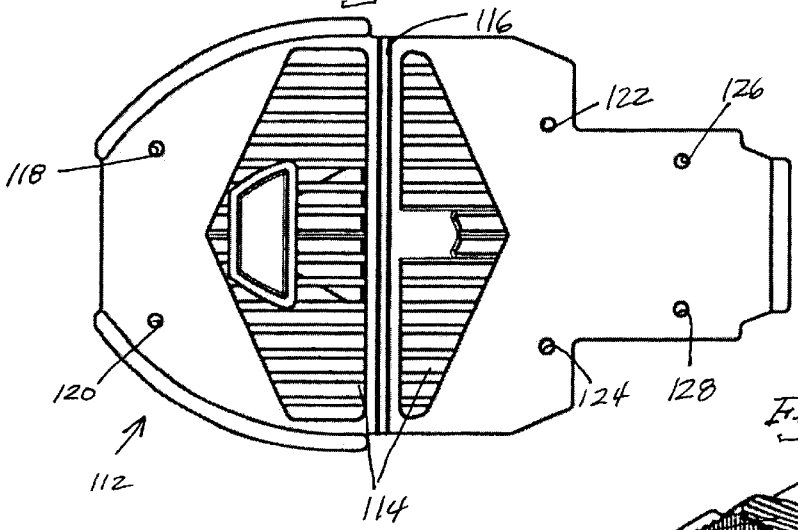
FIG. 14 is a bottom plan view of the foot pad illustrated in FIG. 13.
Figure 17:
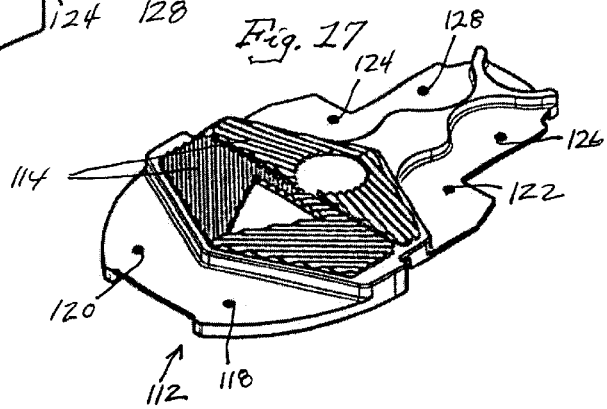
FIG. 17 is an isometric view of the foot pad illustrated in FIGS. 13 through 16.
Figure 16:
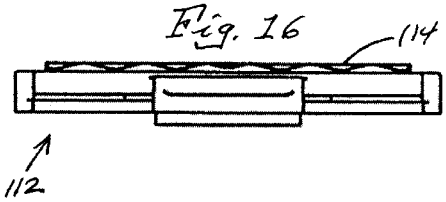
FIG. 16 is a second side view of the foot pad illustrated in FIGS. 13 through 15 from the rear thereof.

Referring next to FIGS. 10 through 12, a binding chassis 80 is illustrated which is made in the preferred embodiment from a metal material such as, for example, 0.125 inch 7075 T6 aluminum, which is cut and bent into the illustrated configuration. In the preferred embodiment, the binding chassis 80 is approximately 7.25 inches long and 4.5 inches wide. The binding chassis 80 has a front base portion 82 and a rear base portion 84 which intersect at an upward angle of approximately 13 degrees. Extending upward vertically from the front of the front base portion 82 is a toe stop 86, which in the preferred embodiment is approximately 1.625 inches-tall.

Extending downwardly from the front base portion 82 at the left and right sides thereof are two toothed claw segments 88 and 90, respectively, which in the preferred embodiment are angled inwardly at the front thereof at an angle of approximately the left Y-shaped side member 20.3 degrees. Extending downwardly from the rear base portion 84 at the left and right sides thereof are two toothed claw segments 92 and 94, respectively, which in the preferred embodiment are angled inwardly at the rear thereof at an angle of approximately 32 degrees. In the preferred embodiment, the toothed claw segments 88 and 90 each have two and one-half teeth, with the half teeth being at the rear of the two toothed claw segments 88 and 90. In the preferred embodiment, the toothed claw segments 88, 90, 92, and 94 all splay outwardly by approximately 5 degrees. In the preferred embodiment, the toothed claw segments 92 and 94 each have four and one-half teeth, with the half teeth being at the front of the toothed claw segments 92 and 94.

In the preferred embodiment, the toothed claw segments 88 and 90 are approximately 3 inches wide, with the teeth varying in length from approximately 0.8125 inch at the front to approximately 1.1875 inch at the rear (all teeth heights are measured from the top surface of the binding chassis the binding chassis 80). In the preferred embodiment, the toothed claw segments 88 and 90 are located approximately 2.375 inches apart in the front and 4.5 inches apart at the rear. In the preferred embodiment, the toothed claw segments 92 and 94 are approximately 2.625 inches wide, with the teeth varying in length from approximately 1.0625 inch at the front to approximately 1 inch at the rear. In the preferred embodiment, the toothed claw segments 92 and 94 are located approximately 4.375 inches apart in the front and 1.625 inches apart at the rear.

Located near opposite sides of the front base portion 82 near the front thereof are two apertures 96 and 98. Located on opposite sides of the rear base portion 84 in an intermediate position are two apertures 100 and 102. Located near opposite sides of the rear base portion 84 near the rear thereof are two apertures 104 and 106. The apertures 96 and 100 will be used as mounting locations for the left Y-shaped side member 40 (illustrated in FIGS. 1 through 5), while the apertures 98 and 102 will be used as mounting locations for a corresponding right Y-shaped side member (not yet illustrated herein). The aperture 104 will be used as a mounting location for the left L-shaped calcaneus wrap member 60 (illustrated in FIGS. 6 through 9), while the aperture 106 will be used as a mounting location for a corresponding right L-shaped calcaneus wrap member (not yet illustrated herein). Also located near opposite sides of the rear base portion 84 near the front thereof are apertures 108 and 110, which will be used to mount the ergonomic snowshoe binding of the present invention onto a snowshoe.

Referring now to FIGS. 13 through 17, a foot pad 112 is illustrated which will be located on top of the binding chassis 80 (illustrated in FIG. 10). Located on the top surface of the foot pad 112 is a textured portion indicated generally by the reference numeral 114, which extends between the left and right sides of the foot pad 112 generally in the area where the ball of a wearer's foot will rest. The textured portion 114 of the foot pad 112 has a higher coefficient of friction to maintain the wearer's foot in place upon the foot pad 112.

Located in the bottom of the foot pad 112 and extending from the left side to the right side is a laterally extending recess 116 which creates a living hinge, enabling the foot pad 112 to bend to fit upon the front base portion 82 and the rear base portion 84 of the binding chassis 80 (illustrated in FIGS. 10 and 11), which are angled with respect to each other.

Located near opposite sides of the foot pad 112 near the front thereof are two apertures 118 and 120. Located near opposite sides of the foot pad 112 at an intermediate position (closer to the rear thereof than to the front thereof) are two apertures 122 and 124. Located near opposite sides of the foot pad 112 near the rear thereof are two apertures 126 and 128. The apertures 118, 120, 122, 124, 126, and 128 in the foot pad 112 will be aligned with the apertures 96, 98, 100, 102, 104, and 106, respectively, in the binding chassis 80 when the foot pad 112 is placed on top of the binding chassis 80.

Figure 18:
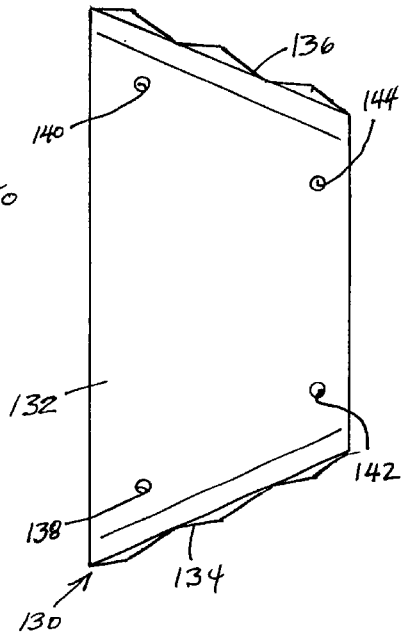
FIG. 18 is a top plan view of a rear claw member having claw portions extending downwardly therefrom.
Figure 20:
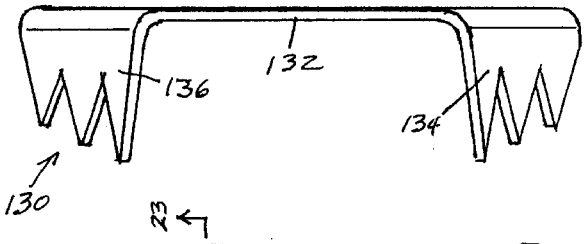
FIG. 20 is a second side view of the binding chassis illustrated in FIGS. 18 and 19 from the front thereof, showing the claw portions extending downwardly therefrom.
Figure 19:
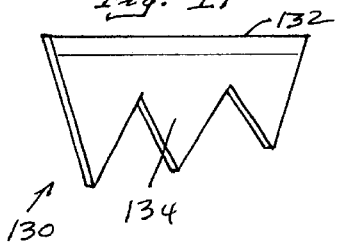
FIG. 19 is a first side view of the binding chassis illustrated in FIG. 18 from the left side thereof, showing the claw portions on the left side thereof.

Referring next to FIGS. 18 through 20, a rear claw member 130 is illustrated which has a base portion 132 and which is made in the preferred embodiment from a metal material such as, for example, 0.125 inch 7075 T6 aluminum, which is cut and bent into the illustrated configuration. Extending downwardly from the base portion 132 at the left and right sides thereof are two toothed claw segments 134 and 136, respectively, which in the preferred embodiment are angled inwardly at the rear thereof at an angle of approximately 23 degrees. In the preferred embodiment, the toothed claw segments 136 and 138 splay outwardly by approximately 5 degrees. Located near opposite sides of the rear claw member 130 near the front thereof are two apertures 138 and 140. Located near opposite sides of the rear claw member 130 near the rear thereof are two apertures 142 and 144. The apertures 138, 140, 142, and 144 will be used to mount the rear claw member 130 onto the snowshoe (not yet illustrated herein).

In the preferred embodiment, the toothed claw segments 134 and 136 each have three teeth. In the preferred embodiment, the toothed claw segments 134 and 136 are approximately 2.375 inches wide, with the teeth varying in length from approximately 1 inch at the front to approximately 0.75 inch at the rear. In the preferred embodiment, the toothed claw segments 134 and 136 are located approximately 4.75 inches apart in the front and 3 inches apart at the rear.

Figure 21:
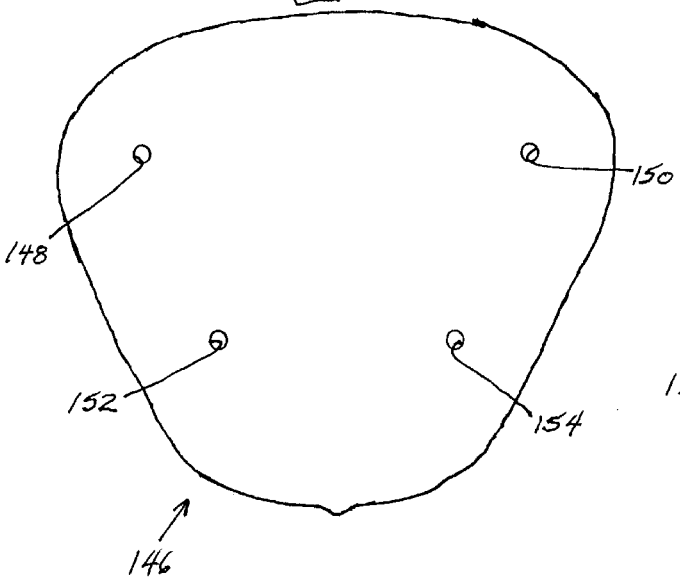
FIG. 21 is a top plan view of a heel pad.

Referring now to FIG. 21, a heel pad 146 is illustrated which is for placement on the top surface of a snowshoe (not yet illustrated herein) on the decking of the snowshoe where the heel of a wearer will rest. Located near opposite sides of the heel pad 146 near the front thereof are two apertures 148 and 150. Located near opposite sides of the heel pad 146 near the rear thereof are two apertures 152 and 154. The apertures 148, 150, 152, and 154 will align with the apertures 138, 140, 142, and 144 in the rear claw member 130 (illustrated in FIG. 18), and will be used to mount the heel pad 146 onto the snowshoe.

The heel pad 146 is relatively thin, and is made of a material which has a good coefficient of friction to retain the heel of a wearer thereupon. In the preferred embodiment, the heel pad 146 may be made by injection molding of a TPE such as the material available from Monsanto Company under the trademark Santoprene®, and preferably is Santoprene® 101-90.

Figure 22:
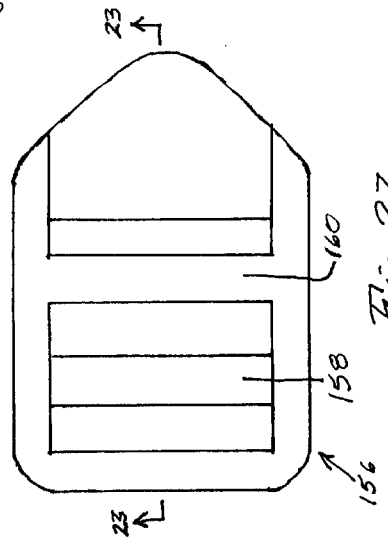
FIG. 22 is a top plan view of a buckle.
Figure 23:
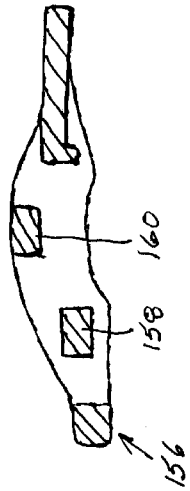
FIG. 23 is a cross-sectional view of the buckle illustrated in FIG. 22.
Figure 24:
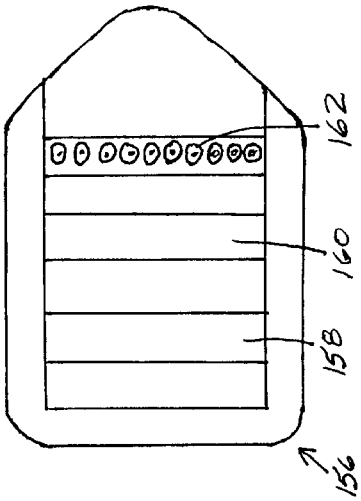
FIG. 24 is a bottom plan view of the buckle illustrated in FIGS. 22 and 23.

Referring next to FIGS. 22 through 24, a buckle 156 is illustrated, two of which will be used in conjunction with straps to retain the ergonomic snowshoe binding of the present invention on the foot of a wearer. The buckle 156 has a first cross-member 158 and a second cross-member 160. One strap will be permanently mounted onto the first cross-member 158, while another strap will extend around the second cross-member 160, being threaded from the bottom of the buckle 156 between the first cross-members 158 and 160, then around the second cross-member 160 and back down to the bottom of the buckle 156. From there, the end of the second strap will bear on a row of teeth 162 located on the bottom of the buckle, which teeth 162 act to retain the second strap in position without loosening.

Figure 25:
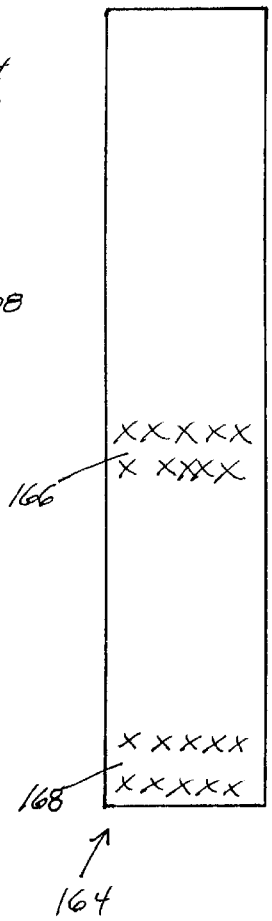
FIG. 25 is a plan view of an Achilles strap.
Figure 26:
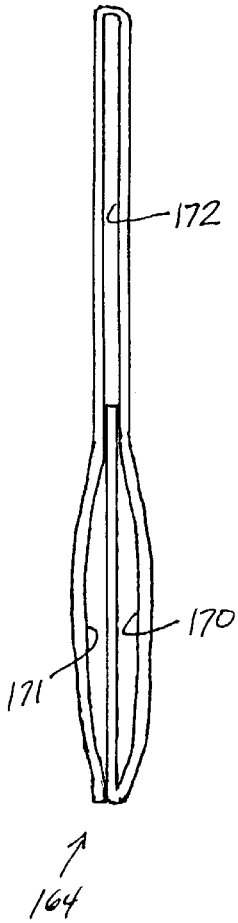
FIG. 26 is an edge view of the Achilles strap illustrated in FIG. 25, showing a loop extending from the top thereof.

Referring now to FIGS. 25 and 26, an Achilles strap 164 which is made out of a segment of woven strap fabric is illustrated. One end of the segment of woven strap fabric is located at the middle of the Achilles strap 164 and extends downward, and then loops to the rear (to the right as viewed in FIG. 26) and upward to the top, and then to the front and down to the bottom. The Achilles strap 164 is stitched together at the middle as indicated generally by the reference numeral 166, and near the bottom as indicated generally by the reference numeral 168.

Note that a small loop 170 is formed at the back of the Achilles strap 164 between the stitching 166 and the stitching 168, and a small loop 171 is formed at the front of the Achilles strap 164. The small loops 170 and 171 will be used to retain straps retaining the ergonomic snowshoe binding of the present invention. A larger loop 172 is formed above the stitching 166, and will be used by a wearer to facilitate entry of the wearer's foot into the ergonomic snowshoe binding. In the preferred embodiment, the Achilles strap 164 is made of nylon woven strap fabric approximately 1 inch wide, and is approximately 5 inches long.

Figure 27:
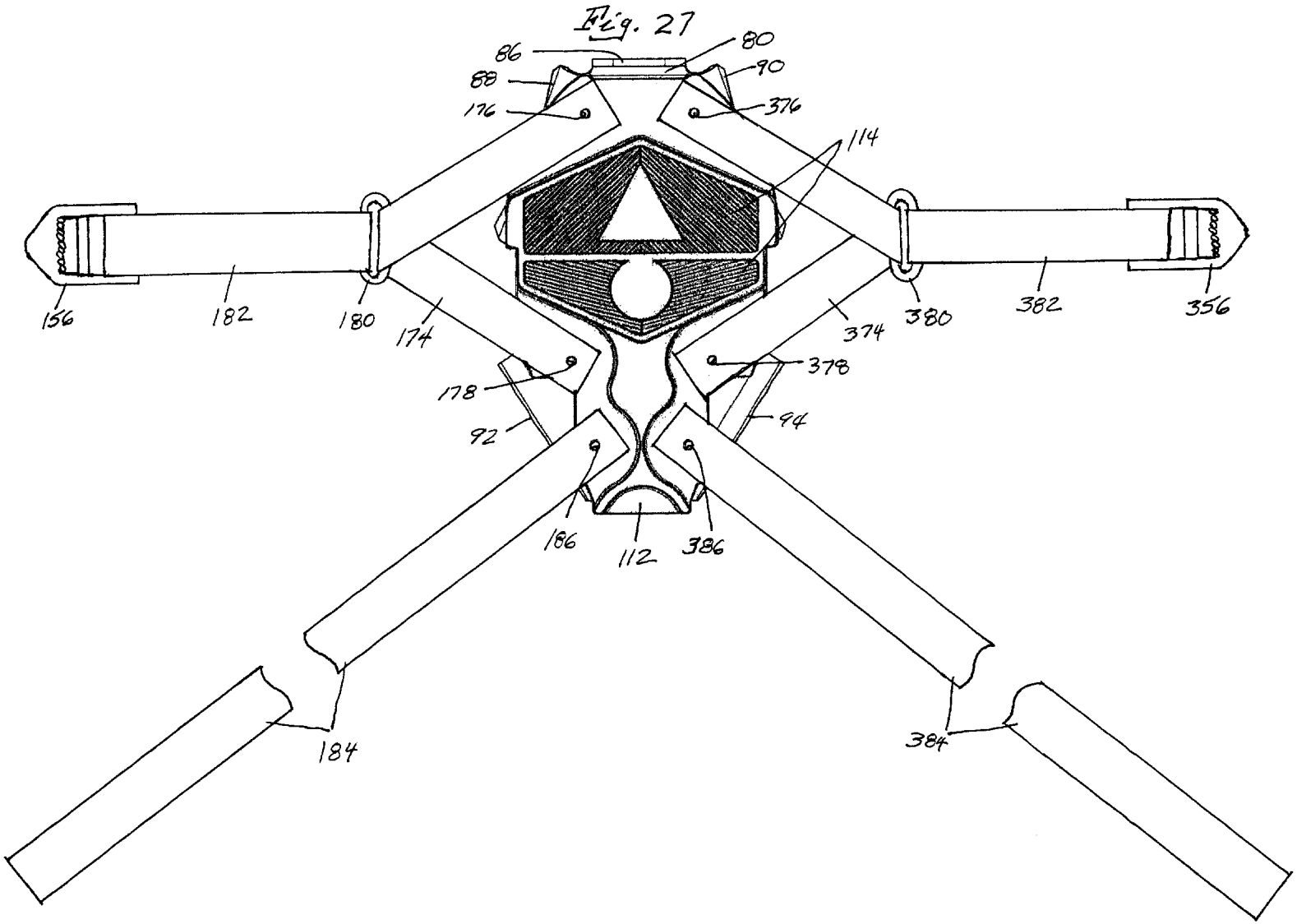
FIG. 27 is a plan view showing the foot pad illustrated in FIGS. 13 through 17 placed upon the binding chassis illustrated in FIGS. 10 through 12, with two looping straps on opposite sides of the foot pad each extending through connecting slip rings, two connecting straps each extending between a slip ring and one of the buckles illustrated in FIGS. 22 through 24, and two long cinch straps on opposite sides of the foot pad near the rear thereof.

Referring next to FIG. 27, the various straps which are used to retain the ergonomic snowshoe binding of the present invention on the foot of a wearer are illustrated laid out over the foot pad 112 and the binding chassis 80. A left looping strap 174 has an aperture 176 in one end thereof and an aperture 178 in the other end thereof. The aperture 176 is aligned with the aperture 118 in the foot pad 112 (illustrated in FIG. 13) and the aperture 96 in the binding chassis 80 (illustrated in FIG. 10). The aperture 178 is aligned with the aperture 122 in the foot pad 112 and the aperture 100 in the binding chassis 80.

The left looping strap 174 extends through a left slip ring 180, which is located at the middle of the left looping strap 174. It will be seen that the left looping strap 174 as placed for mounting is in a V-shaped configuration. In the preferred embodiment, the left looping strap 174 is made of a nylon woven strap material with the ends doubled over to double the thickness at the ends, the woven strap material being approximately 1 inch wide, and approximately 9 inches long (end-to-end length, exclusive of doubling of material at the ends).

A right looping strap 374 (recall that all reference numbers for identical parts on the right side of the ergonomic snowshoe binding of the present invention have a reference numeral which is 200 greater than the corresponding part on the left side) has an aperture 376 in one end thereof and an aperture 378 in the other end thereof. The aperture 376 is aligned with the aperture 120 in the foot pad 112 (illustrated in FIG. 13) and the aperture 98 in the binding chassis 80 (illustrated in FIG. 10). The aperture 378 is aligned with the aperture 124 in the foot pad 112 and the aperture 102 in the binding chassis 80.

The right looping strap 374 extends through a right slip ring 380, which is located at the middle of the right looping strap 374. It will be seen that the right looping strap 374 as placed for mounting is in a V-shaped configuration. In the preferred embodiment, the right looping strap 374 is made of a nylon woven strap material with the ends doubled over to double the thickness at the ends, the woven strap material being approximately 1 inch wide, and approximately 9 inches long (end-to-end length, exclusive of doubling of material at the ends).

A left connecting strap 182 is connected at one end to the left slip ring 180 and at the other end to the first cross-member 158 of the buckle 156 (illustrated in FIG. 24). In the preferred embodiment, the left connecting strap 182 is made of a nylon woven strap material sewn around the left slip ring 180 and the first cross-member 158 of the buckle 156, the woven strap material being approximately 1 inch wide, and approximately 4 inches long (the distance from the left slip ring 180 to the first cross-member 158).

A right connecting strap 382 is connected at one end to the right slip ring 380 and at the other end to the first cross-member of the buckle 356 (the buckle 156 and the first cross-member 158 are illustrated in FIG. 24). In the preferred embodiment, the right connecting strap 382 is made of a nylon woven strap material sewn around the right slip ring 380 and the first cross-member 358 of the buckle 356, the woven strap material being approximately 1 inch wide, and approximately 4 inches long (the distance from the right slip ring 380 to the first cross-member).

A left cinch strap 184 has an aperture 186 in one end thereof, which aperture 186 is aligned with the aperture 126 in the foot pad 112 (illustrated in FIG. 13) and the aperture 104 in the binding chassis 80 (illustrated in FIG. 10). The left cinch strap 184 extends to the left and the rear from its point of attachment. In the preferred embodiment, the left cinch strap 184 is made of a nylon woven strap material with the secured end doubled over to double the thickness at that end, the woven strap material being approximately 1 inch wide, and approximately 30 inches long (end-to-end length, exclusive of doubling of material at the secured end).

A right cinch strap 384 has an aperture 386 in one end thereof, which aperture 386 is aligned with the aperture 128 in the foot pad 112 (illustrated in FIG. 13) and the aperture 106 in the binding chassis 80 (illustrated in FIG. 10). The right cinch strap 384 extends to the right and the rear from its point of attachment. In the preferred embodiment, the right cinch strap 384 is made of a nylon woven strap material with the secured end doubled over to double the thickness at that end, the woven strap material being approximately 1 inch wide, and approximately 30 inches long (end-to-end length, exclusive of doubling of material at the secured end).

Figure 28:
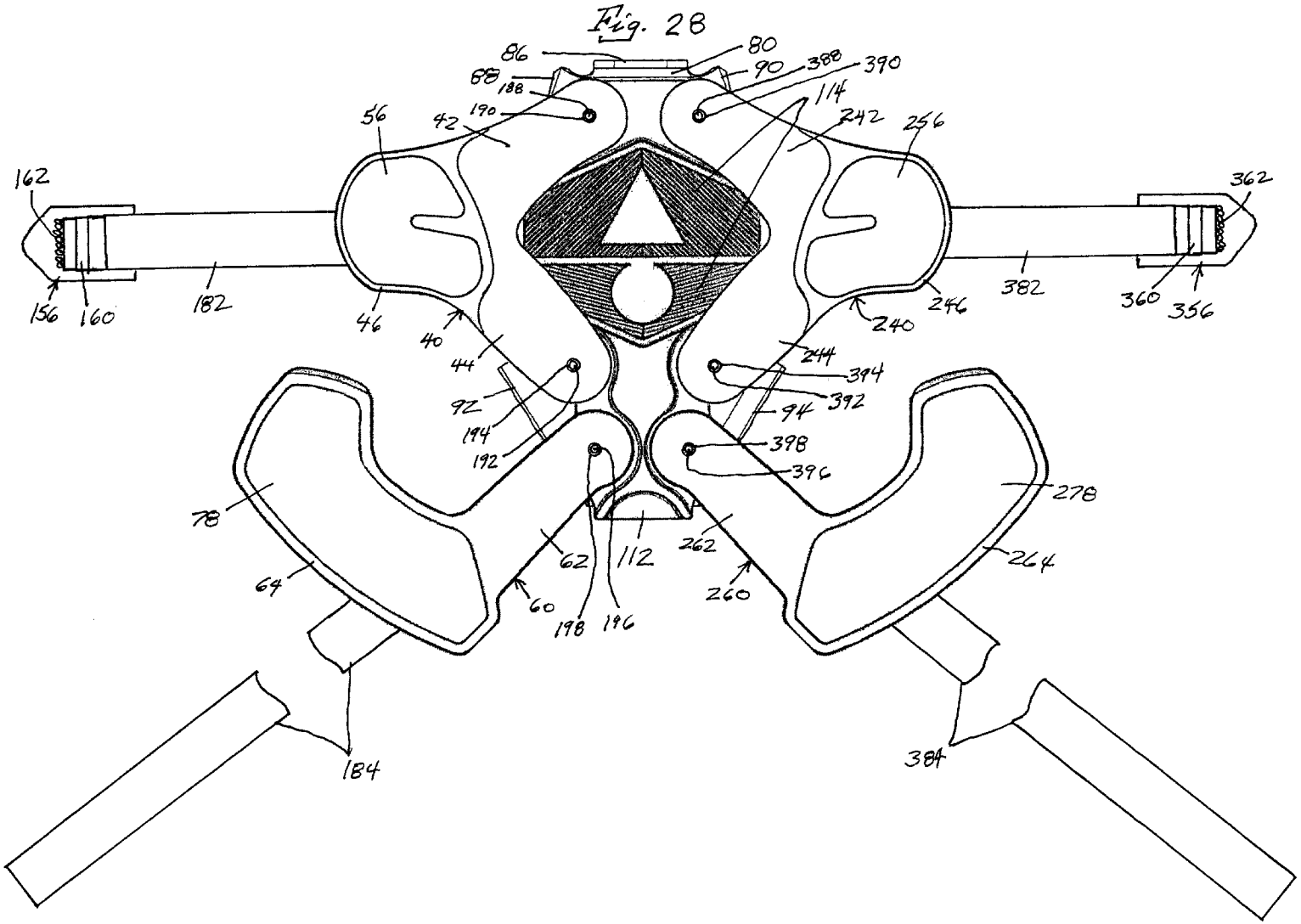
FIG. 28 is a plan view showing the installation of the Y-shaped side member illustrated in FIGS. 1 through 5 (and a corresponding Y-shaped side member on the right side) and the L-shaped calcaneus wrap member illustrated in FIGS. 6 through 9 (and a corresponding L-shaped calcaneus wrap member on the right side) onto the assembly illustrated in FIG. 27.

Referring now to FIG. 28, the installation of the left Y-shaped side member 40, the corresponding the right Y-shaped side member 240, the left L-shaped calcaneus wrap member 60, and the corresponding right L-shaped calcaneus wrap member 260 is illustrated. The assembly is done with a plurality of rivets inserted from the bottom of the binding chassis 80, extending through the various materials and through washers, with the rivets then being secured.

A rivet 188 extends sequentially through the aperture 96 in the binding chassis 80 (illustrated in FIG. 10), the aperture 118 in the foot pad 112 (illustrated in FIG. 13), the aperture 176 in the left looping strap 174 (illustrated in FIG. 27), the aperture 48 in the left Y-shaped side member 40 (illustrated in FIG. 1), and a washer 190. A rivet 192 extends sequentially through the aperture 100 in the binding chassis 80 (illustrated in FIG. 10), the aperture 122 in the foot pad 112 (illustrated in FIG. 13), the aperture 178 in the left looping strap 174 (illustrated in FIG. 27), the aperture 50 in the left Y-shaped side member 40 (illustrated in FIG. 1), and a washer 194. The buckle 156 and the left connecting strap 182 are then threaded through the integral retaining loop 52 in the leg 46 of the Y of the left Y-shaped side member 40 (illustrated in FIG. 2).

Figure 2:
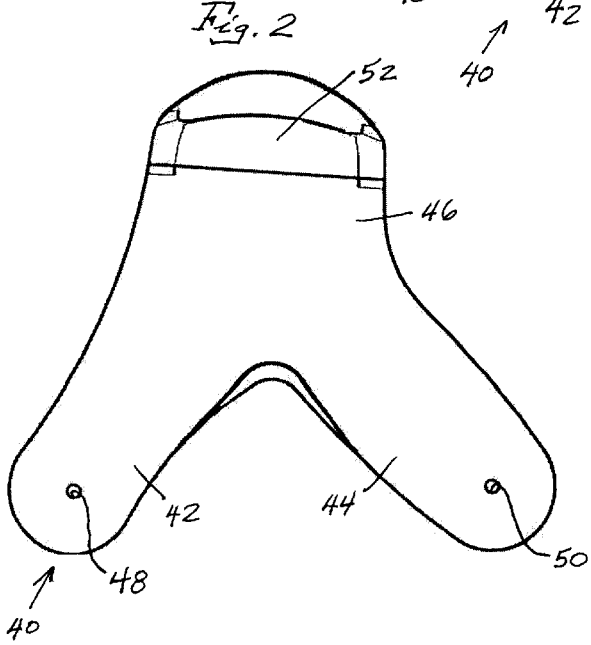
FIG. 2 is a plan view of the Y-shaped side member illustrated in FIG. 1 from the outside thereof.

A rivet 388 extends sequentially through the aperture 98 in the binding chassis 80 (illustrated in FIG. 10), the aperture 120 in the foot pad 112 (illustrated in FIG. 13), the aperture 376 in the right looping strap 374 (illustrated in FIG. 27), the aperture 248 in the right Y-shaped side member 240 (the aperture 48 in the left Y-shaped side member 40 is illustrated in FIG. 1), and a washer 390. A rivet 392 extends sequentially through the aperture 102 in the binding chassis 80 (illustrated in FIG. 10), the aperture 124 in the foot pad 112 (illustrated in FIG. 13), the aperture 378 in the right looping strap 374 (illustrated in FIG. 27), the aperture 250 in the right Y-shaped side member 240 (the aperture 50 in the left Y-shaped side member 40 is illustrated in FIG. 1), and a washer 394. The buckle 356 and the left connecting strap 382 are then threaded through the integral retaining loop 252 in the leg 246 of the Y of the left Y-shaped side member 240 (the integral retaining loop 52 of the leg 46 of the Y of the left Y-shaped side member 40 is illustrated in FIG. 2).

Figure 6:
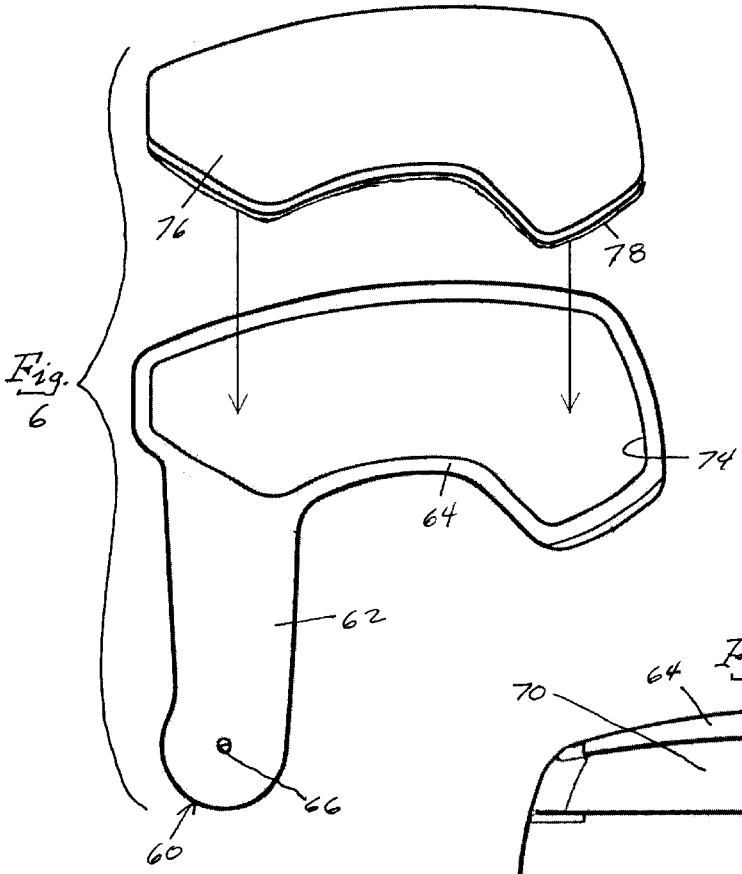
FIG. 6 is an exploded view showing the installation of a cushioning pad into the inside of an L-shaped calcaneus wrap member for placement on the left side of a wearer's foot.

A rivet 196 extends sequentially through the aperture 104 in the binding chassis 80 (illustrated in FIG. 10), the aperture 126 in the foot pad 112 (illustrated in FIG. 13), the aperture 186 in the left cinch strap 184 (illustrated in FIG. 27), the aperture 66 in the left L-shaped calcaneus wrap member 60 (illustrated in FIG. 6), and a washer 198. A rivet 396 extends sequentially through the aperture 106 in the binding chassis 80 (illustrated in FIG. 10), the aperture 128 in the foot pad 112 (illustrated in FIG. 13), the aperture 386 in the right cinch strap 384 (illustrated in FIG. 27), the aperture 266 in the left L-shaped calcaneus wrap member 260 (the aperture 66 in the left L-shaped calcaneus wrap member 60 is illustrated in FIG. 6), and a washer 398.

Figure 29:
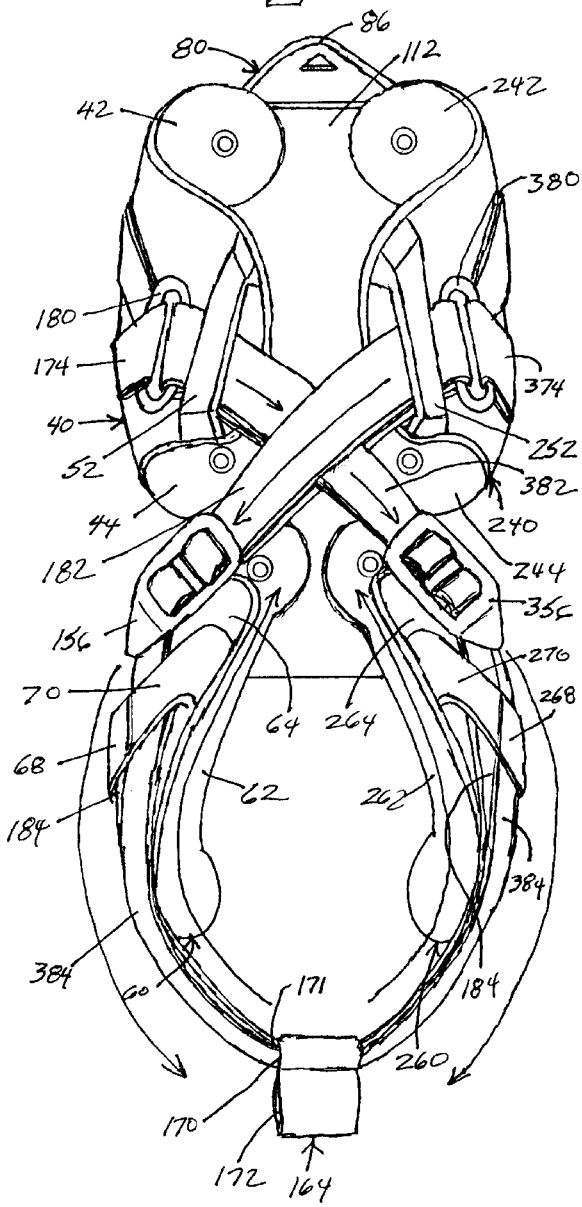
FIG. 29 is a top plan view of the assembled ergonomic snowshoe binding of the present invention, including the components illustrated in FIG. 28 and the Achilles strap illustrated in FIGS. 25 and 26, and showing the calcanean wrapping technique utilized by the ergonomic snowshoe binding of the present invention.

Referring next to FIG. 29, the installation of the left cinch strap 184 and the right cinch strap 384 into the Achilles strap 164, the left L-shaped calcaneus wrap member 60, and the right L-shaped calcaneus wrap member 260 is illustrated. The left cinch strap 184 is inserted through the integral retaining loop 68 of the left L-shaped calcaneus wrap member 60, then through the small loop 171 in the Achilles strap 164 from the left side to the right side, and then through the integral retaining loop 270 in the right L-shaped calcaneus wrap member 260. The buckle 156 and the portion of the left connecting strap 182 to which it is attached are threaded through the right connecting strap 382. The left cinch strap 184 is then threaded into the buckle 156 from the bottom, up and around the second cross-member 160, and back to the bottom, bringing the left cinch strap 184 into contact with the teeth 162 in the buckle 156.

The right cinch strap 384 is inserted through the integral retaining loop 268 of the right L-shaped calcaneus wrap member 260, then through the small loop 170 in the Achilles strap 164 from the left side to the right side (behind the left cinch strap 184), and then through the integral retaining loop 70 in the left L-shaped calcaneus wrap member 60. The right cinch strap 384 is then threaded into the buckle 356 from the bottom, up and around the second cross-member 360, and back to the bottom, bringing the right cinch strap 384 into contact with the teeth 362 in the buckle 356.

It will thus be appreciated by those skilled in the art that to enter the ergonomic snowshoe binding of the present invention, the left and right cinch straps 184 and 384 are loosened from the buckles 156 and 384, respectively. The wearer's foot is placed into the ergonomic snowshoe binding, and the left and right cinch straps 184 and 384 are pulled to tighten the ergonomic snowshoe binding on the wearer's foot. The teeth 162 and 362 in the buckles 156 and 356 will retain the left and right cinch straps 184 and 384 in place until the buckles are pulled forward to release the left and right cinch straps 184 and 384.

Figure 31:
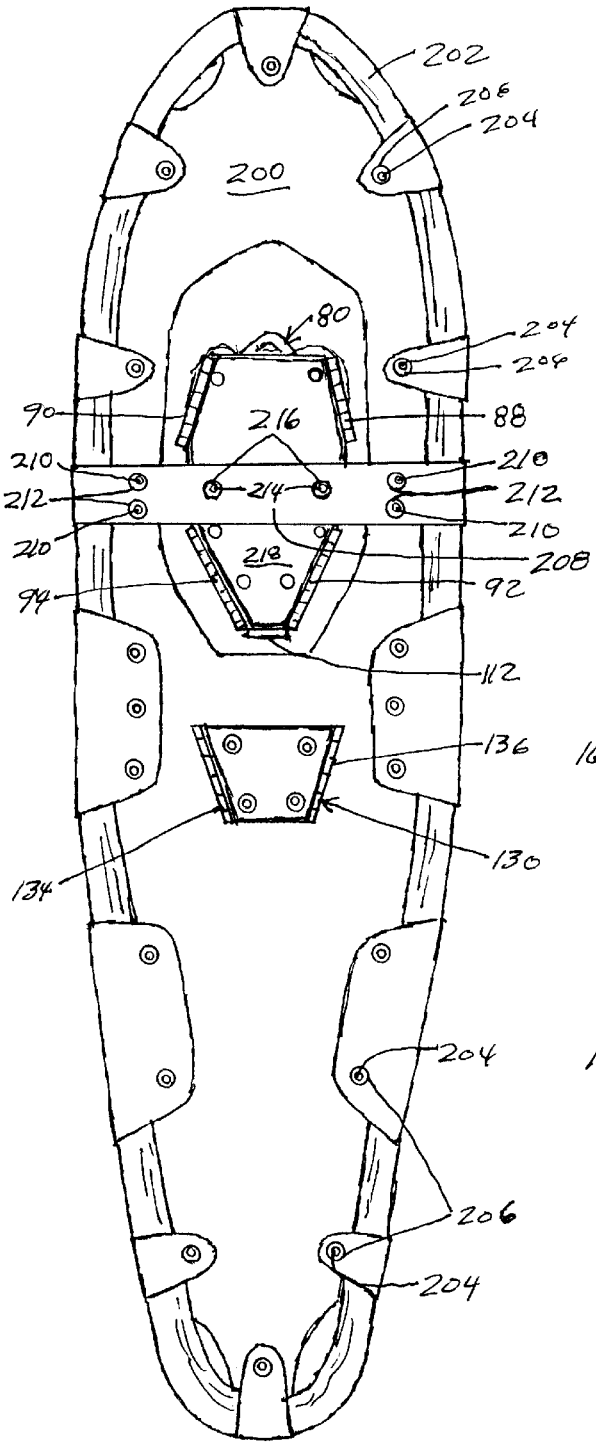
FIG. 31 is a bottom plan view of the snowshoe and the ergonomic snowshoe binding illustrated in FIG. 30.
Figure 30:
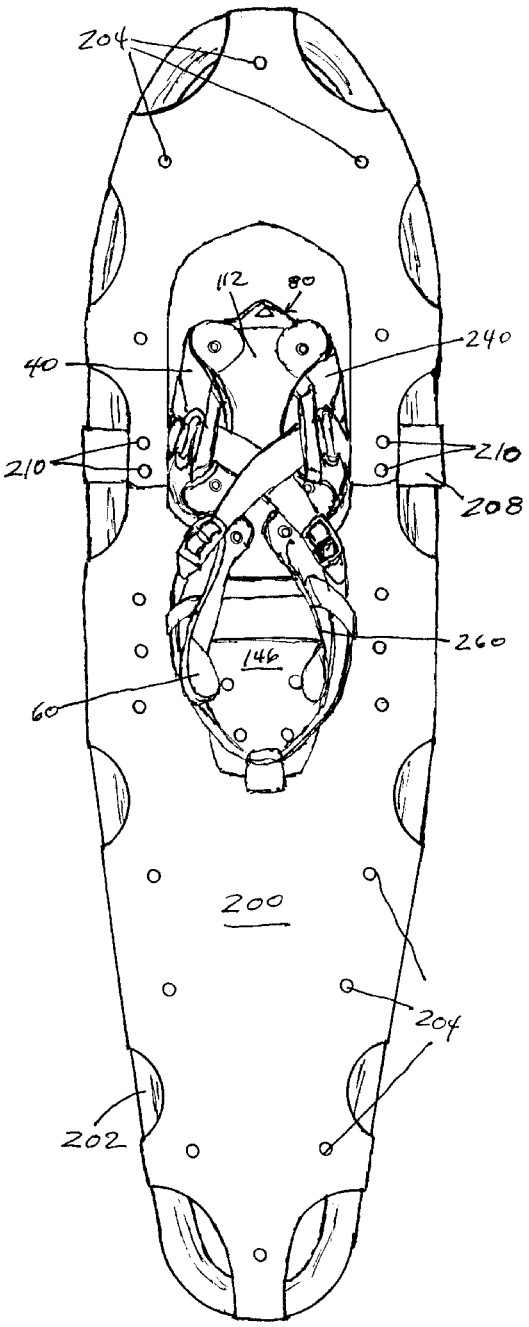
FIG. 30 is a top plan view of the ergonomic snowshoe binding of the present invention as illustrated in FIG. 29 installed onto a snowshoe.

Referring now to FIGS. 30 and 31, the installation of the ergonomic snowshoe binding of the present invention onto a snowshoe is illustrated. The snowshoe itself has a decking 200 which is mounted onto a tubular aluminum frame 202 using a plurality of rivets 204 and washers 206, as is conventional. In the preferred embodiment, the frame 202 is made of 6063 T832 aluminum, with a long-lasting anodized finish to repel snow. Alternately, the frame 202 can be powder coated. The decking 200 of the preferred embodiment is made of 1050 denier nylon, which resists cracking and tearing, and is preferable coated with polyurethane on the bottom side thereof and PVC on the top side thereof to resist abrasion and extend the life of the snowshoe.

The binding illustrated in FIGS. 30 and 31 is mounted in a fixed rotation manner, with a mounting strap 208 extending between the sides of the frame 202 and riveted in place on both the top and bottom sides of the decking 200 using four rivets 210 and washers 212. The binding chassis 80 is secured to the mounting strap 208 using studs 214 extending from the apertures 108 and 110 in the binding chassis 80 (illustrated in FIG. 10), together with nut/washer hardware 216. Alternately, rivets and washers could also be used.

Also shown on the bottom of the binding chassis 80 in FIG. 31 is a thin sheet 218 made of polyethylene, which prevents snow from sticking to the bottom of the binding chassis 80. Finally, four rivets 220 and four washers 222 are used to secure the heel pad 146 located on the top side of the decking 200 (illustrated in FIG. 30) to the rear claw member 130 located on the bottom side of the decking 200 (illustrated in FIG. 31). The rivets 220 extend through corresponding apertures 148, 150, 152, and 154 in the heel pad 146 (illustrated in FIG. 21), apertures in the decking 200 (not illustrated herein), and apertures 138, 140, 142, and 144 in the rear claw member 130.

Figure 32:
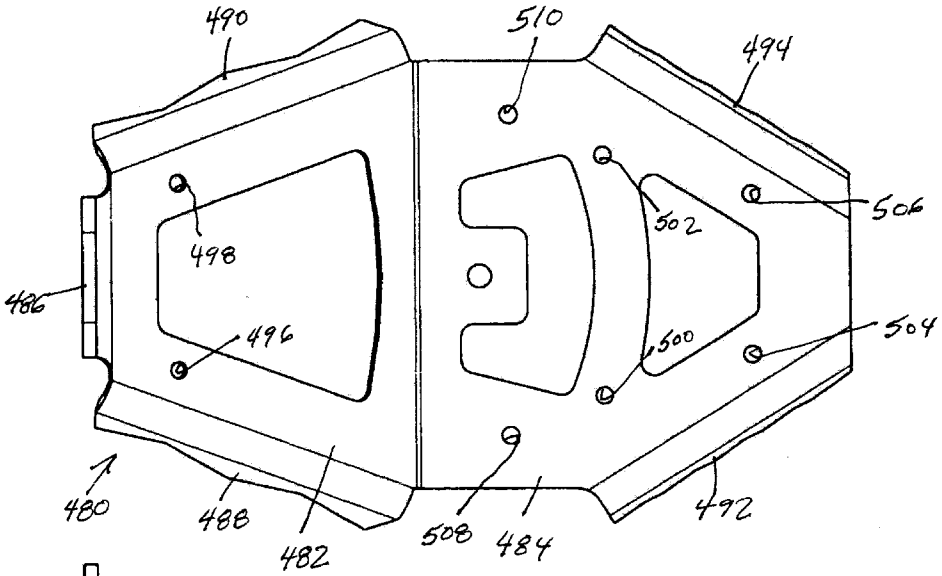
FIG. 32 is a top plan view of a binding chassis similar to the binding chassis illustrated in FIGS. 10 through 12, but having somewhat longer claw portions extending downwardly therefrom.
Figure 33:
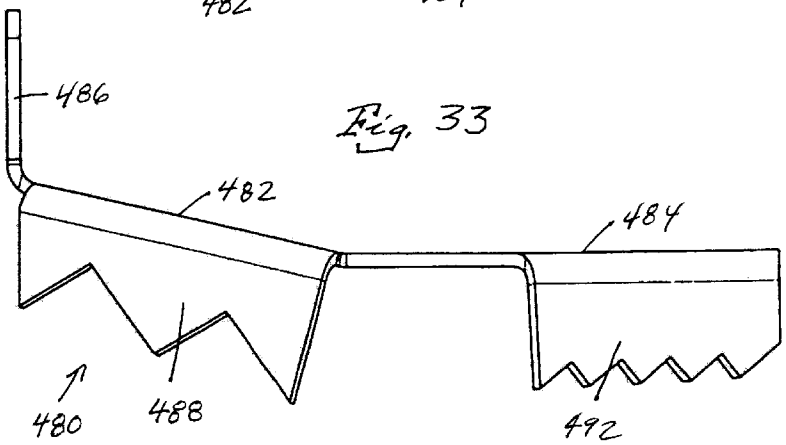
FIG. 33 is a first side view of the binding chassis illustrated in FIG. 32 from the left side thereof, showing the claw portions on the left side thereof.
Figure 34:
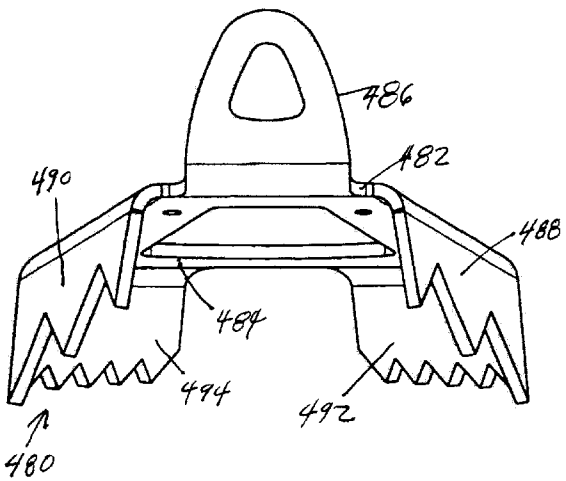
FIG. 34 is a second side view of the binding chassis illustrated in FIGS. 32 and 33 from the front thereof, showing the claw portions extending downwardly therefrom.

Referring finally to FIGS. 32 through 34, an alternate embodiment binding chassis 480 is illustrated which has longer claws. The alternate embodiment binding chassis 480 is again made in the preferred embodiment from a metal material such as, for example, 0.125 inch 7075 T6 aluminum, which is cut and bent into the illustrated configuration With the exception of the length of the teeth, the dimensions of the binding chassis 480 are identical to those of the binding chassis 80 illustrated in FIGS. 10 through 12. The binding chassis 480 has a front base portion 482 and a rear base portion 484, and extending upward vertically from the front of the front base portion 482 is a toe stop 486. Extending downwardly from the front base portion 482 at the left and right sides thereof are two toothed claw segments 488 and 490, respectively. Extending downwardly from the rear base portion 484 at the left and right sides thereof are two toothed claw segments 492 and 494, respectively.

In the preferred embodiment, the teeth in the toothed claw segments 488 and 490 vary in length from approximately 1.1875 inch at the front to approximately 1.4 inch at the rear (all teeth heights are measured from the top surface of the binding chassis the binding chassis 480). In the preferred embodiment, the teeth in the toothed claw segments 492 and 494 vary in length from approximately 1.25 inch at the front to approximately 1.1875 inch at the rear.

Located near opposite sides of the front base portion 482 near the front thereof are two apertures 496 and 498. Located on opposite sides of the rear base portion 484 in an intermediate position are two apertures 500 and 502. Also located near opposite sides of the rear base portion 484 near the front thereof are apertures 508 and 510, which will be used to mount the ergonomic snowshoe binding of the present invention onto a snowshoe.

It may therefore be appreciated from the above detailed description of the preferred embodiment of the present invention that it teaches an improved binding for use in securing a snowshoe to the boot of the wearer in a manner which is both secure and comfortable, and which affords complete control over the snowshoe on which the binding is mounted. The improved binding of the present invention holds the wearer's boot securely in place when attached, and keeps front to back, lateral, and rotational foot slippage to a minimum such that the binding of the present invention acts as an extension of the foot. The binding of the present invention also distribute forces evenly, such that clamping and compressive loads are evenly distributed about the entire area of the wearer's foot in an ergonomic fashion emulating the muscular system of the foot.

The binding of the present invention is easy to operate, even while wearing gloves or mittens, and the securing mechanism is located where it is easily accessible on the side and/or the top of the foot rather than behind the foot. The binding of the present invention is quick to secure, and requires only a single step to both adjust it and secure it, making it very simple to use. Once the binding of the present invention has been fastened to the foot, it will stay secured and properly adjusted until it is removed.

The binding of the present invention accommodates a wide variety of sizes of foot and any type of boot or shoe, or even stockings or bare feet for applications beyond use as a snowshoe binding, thereby minimizing or entirely eliminating the requirement for different size bindings to accommodate different wearers. The binding of the present invention is of an ambidextrous design, thereby fitting either foot without requiring different left and right binding designs. The binding of the present invention allows for use with either a fixed rotation or a free rotation mounting system, or with the hybrid arrangement of the above incorporated by reference '722 patent.

The binding of the present invention is of a construction which is both durable and long lasting, and which will require little or no maintenance to be provided by the user throughout its operating lifetime. The binding of the present invention is also of inexpensive construction to enhance its market appeal and to thereby afford it the broadest possible market. Finally, all of the aforesaid advantages and objectives of the binding of the present invention are achieved without incurring any substantial relative disadvantage.

Although an exemplary embodiment of the binding of the present invention has been shown and described with reference to particular embodiments and applications thereof, it will be apparent to those having ordinary skill in the art that a number of changes, modifications, or alterations to the binding of the invention as described herein may be made, none of which depart from the spirit or scope of the present invention. All such changes, modifications, and alterations should therefore be seen as being within the scope of the present invention.

What is claimed is:

1. A binding for mounting on a snowshoe for releasably retaining the foot of a wearer therein, said binding comprising:

a base member which may be mounted on the snowshoe, said base member being arranged and configured to support at least a forward portion of the foot of a wearer, said base member having a left side and a right side and a front side and a rear side;

a first fastening member having first and second ends, said first end of said first fastening member being connected to said base member so as to extend from said left side of said base member, said second end of said first fastening member being connected to said base member so as to extend from said left side of said base member at a location forward of said first end of said first fastening member, said second end of said first fastening member including a first looping strap having a pair of ends, each of which is interconnected with the base member, said first fastening member including a first connecting strap interconnected with said first looping strap via a first slip joint, said first fastening member being arranged and configured to wrap around the right side of the calcaneus of the foot of a wearer;

a second fastening member having first and second ends, said first end of said second fastening member being connected to said base member so as to extend from said right side of said base member, said second end of said second fastening member being connected to said base member so as to extend from said right side of said base member at a location forward of said first end of said second fastening member, said second end of said second fastening member including a second looping strap having a pair of ends, each of which is interconnected with the base member, said second fastening member including a second connecting strap interconnected with said second looping strap via a second slip joint, said second fastening member being arranged and configured to wrap around the left side of the calcaneus of the foot of a wearer, said first and second fastening members being of adjustable length to accommodate a variety of foot sizes and to allow said binding to be releasably secured to the foot of a wearer.

2. A binding as defined in claim 1, wherein said base member comprises:

a binding chassis made of metal, said binding chassis having a top side and a bottom side and a left side and a right side and a front side and a rear side; and a foot pad located on said top side of said binding chassis, wherein said foot pad is made of a material providing a relatively high coefficient of friction.

3. A binding as defined in claim 2, wherein said binding chassis comprises:

a toe stop which extends upward vertically from the front side of said binding chassis.

4. A binding as defined in claim 2, wherein said binding chassis comprises:

a front base portion; and a rear base portion;

wherein said front base portion is angled upwardly from said rear base portion.

5. A binding as defined in claim 4, wherein said binding chassis comprises:

a first toothed claw segment extending downwardly from said front base portion at said left side of said binding chassis;

a second toothed claw segment extending downwardly from said front base portion at said right side of said binding chassis;

a third toothed claw segment extending downwardly from said rear base portion at said left side of said binding chassis; and a fourth toothed claw segment extending downwardly from said rear base portion at said right side of said binding chassis.

6. A binding as defined in claim 1, wherein said first connecting strap comprises:

a first strap member having a first end secured to said base member at a location near said left side and said rear side of said base member, said first strap member also having a second end;

a second strap member having a first end secured to said first slip joint, said second strap member also having a second end; and a first buckle secured to said second end of one of said first and second strap members, said first buckle being operable to engage said second end of the other of said first and second strap members in a manner allowing for a variable adjustment of the length of the portion of said other of said first and second strap members between said first end of said other of said first and second strap members and said first buckle; and wherein said second connecting strap comprises:

a third strap member having a first end secured to said base member at a location near said right side and said rear side of said base member, said third strap member also having a second end;

a fourth strap member having a first end secured to said second slip joint, said fourth strap member also having a second end; and a second buckle secured to said second end of one of said third and fourth strap members, said second buckle being operable to engage said second end of the other of said third and fourth strap members in a manner allowing for a variable adjustment of the length of the portion of said other of said third and fourth strap members between said first end of said other of said third and fourth strap members and said second buckle.

7. A binding as defined in claim 6, wherein said first buckle is secured to said second end of said second strap member, said first buckle being operable to engage said second end of said first strap member in a manner allowing for a variable adjustment of the length of the portion of said first strap member between said first end of said first strap member and said first buckle, and wherein said second buckle is secured to said second end of said fourth strap member, said second buckle being operable to engage said second end of said third strap member in a manner allowing for a variable adjustment of the length of the portion of said third strap member between said first end of said third strap member and said second buckle.

8. A binding for mounting on a snowshoe for releasably retaining the foot of a wearer therein, said binding comprising:

a base member which may be mounted on the snowshoe, said base member being arranged and configured to support at least a forward portion of the foot of a wearer, said base member having a left side and a right side and a front side and a rear side;

a first fastening member having first and second ends, said first end of said first fastening member being connected to said base member and extending from said left side and said rear side of said base member, said second end of said first fastening member being connected to said base member and extending from said left side of said base member and intermediate said front and rear sides of said base member, said first fastening member being arranged and configured to wrap around the right side of the calcaneus of the foot of a wearer, wherein said first fastening member comprises a first strap member having a first end secured to said base member adjacent said left side and said rear side of said base member, said first strap member also having a second end; a second strap member having a first end secured to said base member adjacent said left side of said base member and intermediate said front and back sides of said base member, said second strap member also having a second end; and a first buckle secured to said second end of one of said first and second strap members, said first buckle being operable to engage said second end of the other of said first and second strap members in a manner allowing for a variable adjustment of the length of the portion of said other of said first and second strap members between said first end of said other of said first and second strap members and said first buckle; wherein said second strap member comprises:

a first looping strap having a first end secured to said base member adjacent said left side and said front side of said base member, said first looping strap also having a second end secured to said base member adjacent said left side of said base member and intermediate said front and back sides of said base member;

a first connecting strap having a first end and a second end, said second end of said first connecting strap comprising said second end of said second strap member; and a first slip ring connecting said second end of said first looping strap to said first end of said first connecting strap; and a second fastening member having first and second ends, said first end of said second fastening member being connected to said base member and extending from said right side and said rear side of said base member, said second end of said second fastening member being connected to said base member and extending from said right side of said base member and intermediate said front and rear sides of said base member, said second fastening member being arranged and configured to wrap around the left side of the calcaneus of the foot of a wearer, said first and second fastening members being of adjustable length to accommodate a variety of foot sizes and to allow said binding to be releasably secured to the foot of a wearer, wherein said second fastening member comprises a third strap member having a first end secured to said base member adjacent said right side and said rear side of said base member, said third strap member also having a second end; a fourth strap member having a first end secured to said base member adjacent said right side of said base member and intermediate said front and back sides of said base member, said fourth strap member also having a second end; and a second buckle secured to said second end of one of said third and fourth strap members, said second buckle being operable to engage said second end of the other of said third and fourth strap members in a manner allowing for a variable adjustment of the length of the portion of said other of said third and fourth strap members between said first end of said other of said third and fourth strap members and said second buckle;

wherein said fourth strap member comprises:

a second looping strap having a first end secured to said base member adjacent said right side and said front side of said base member, said second looping strap also having a second end secured to said base member adjacent said right side of said base member and intermediate said front and back sides of said base member;

a second connecting strap having a first end and a second end, said second end of said second connecting strap comprising said second end of said fourth strap member; and a second slip ring connecting said second end of said second looping strap to said first end of said third connecting strap.

9. A binding as defined in claim 8, wherein said first and second ends of said first connecting strap, said first and second ends of said second connecting strap, and said first ends of said first and third strap members are all secured to said base member in a manner allowing for lateral pivoting of first and second ends of said first connecting strap, said first and second ends of said second connecting strap, and said first ends of said first and third strap members.

10. A binding for mounting on a snowshoe for releasably retaining the foot of a wearer therein, said binding comprising:

a base member which may be mounted on the snowshoe, said base member being arranged and configured to support at least a forward portion of the foot of a wearer, said base member having a left side and a right side and a front side and a rear side;

a first fastening member having first and second ends, said first end of said first fastening member being connected to said base member and extending from said left side and said rear side of said base member, said second end of said first fastening member being connected to said base member and extending from said left side of said base member and intermediate said front and rear sides of said base member, said first fastening member being arranged and configured to wrap around the right side of the calcaneus of the foot of a wearer, wherein said first fastening member comprises a first strap member having a first end secured to said base member adjacent said left side and said rear side of said base member, said first strap member also having a second end; a second strap member having a first end secured to said base member adjacent said left side of said base member and intermediate said front and back sides of said base member, said second strap member also having a second end; and a first buckle secured to said second end of one of said first and second strap members, said first buckle being operable to engage said second end of the other of said first and second strap members in a manner allowing for a variable adjustment of the length of the portion of said other of said first and second strap members between said first end of said other of said first and second strap members and said first buckle;

a second fastening member having first and second ends, said first end of said second fastening member being connected to said base member and extending from said right side and said rear side of said base member, said second end of said second fastening member being connected to said base member and extending from said right side of said base member and intermediate said front and rear sides of said base member, said second fastening member being arranged and configured to wrap around the left side of the calcaneus of the foot of a wearer, said first and second fastening members being of adjustable length to accommodate a variety of foot sizes and to allow said binding to be releasably secured to the foot of a wearer, wherein said second fastening member comprises a third strap member having a first end secured to said base member adjacent said right side and said rear side of said base member, said third strap member also having a second end; a fourth strap member having a first end secured to said base member adjacent said right side of said base member and intermediate said front and back sides of said base member, said fourth strap member also having a second end; and a second buckle secured to said second end of one of said third and fourth strap members, said second buckle being operable to engage said second end of the other of said third and fourth strap members in a manner allowing for a variable adjustment of the length of the portion of said other of said third and fourth strap members between said first end of said other of said third and fourth strap members and said second buckle;

a first side member secured to said base member adjacent said left side of said base member and intermediate said front and back sides of said base member, said first end of said second strap member being located intermediate said first side member and said base member at the point at which said first side member and said first end of said second strap member are secured to said base member;

a second side member secured to said base member adjacent said right side of said base member and intermediate said front and back sides of said base member, said first end of said fourth strap member being located intermediate said second side member and said base member at the point at which said second side member and said first end of said fourth strap member are secured to said base member;

a first calcaneus wrap member secured to said base member adjacent said left side of said rear side of said base member, said first end of said first strap member being located intermediate said first calcaneus wrap member and said base member at the point at which said first calcaneus wrap member and aid first end of said first strap member are secured to said base member; and a second calcaneus wrap member secured to said base member adjacent said right side of said rear side of said base member, said first end of said third strap member being located intermediate said second calcaneus wrap member and said base member at the point at which said second calcaneus wrap member and said first end of said third strap member are secured to said base member.

11. A binding as defined in claim 10, wherein said first side member has an inner surface which will face the foot of a wearer and an outer surface, a proximal portion of said second strap member being located close adjacent said outer surface of said first side member, and wherein said second side member has an inner surface which will face the foot of a wearer and an outer surface, a proximal portion of said fourth strap member being located close adjacent said outer surface of said second side member, and wherein said first calcaneus wrap member has an inner surface which will face the foot of a wearer and an outer surface, a proximal portion of said first strap member being located close adjacent said outer surface of said first calcaneus wrap member, and wherein said second calcaneus wrap member has an inner surface which will face the foot of a wearer and an outer surface, a proximal portion of said third strap member being located close adjacent said outer surface of said second calcaneus wrap member.

12. A binding as defined in claim 11, additionally comprising:

a first integral retaining loop located on said back side of said first side member, said second strap member passing through said first integral retaining loop;

a second integral retaining loop located on said back side of said second side member, said fourth strap member passing through said second integral retaining loop;

third and fourth integral retaining loops located on said back side of said first calcaneus wrap member, said third integral retaining loop being located intermediate said fourth integral retaining loop and a plane containing said base member; and fifth and sixth integral retaining loops located on said back side of said second calcaneus wrap member, said fifth integral retaining loop being located intermediate said sixth integral retaining loop and said plane containing said base member; wherein said first strap member passes consecutively through said third integral retaining loop and said sixth integral retaining loop prior to being engaged by said first buckle, and wherein said third strap member passes consecutively through said fifth integral retaining loop and said fourth integral retaining loop prior to being engaged by said second buckle.

13. A binding as defined in claim 11, additionally comprising:

a first cushioning pad located on said inner surface of said first side member;

a second cushioning pad located on said inner surface of said second side member;

a third cushioning pad located on said inner surface of said first calcaneus wrap member; and a fourth cushioning pad located on said inner surface of said second calcaneus wrap member.

14. A binding as defined in claim 13, wherein said first, second, third, and fourth cushioning pads are made of Ethylene Vinyl Acetate (EVA)resilient plastic foam material.

15. A binding as defined in claim 10, wherein said first and second side members and said first and second calcaneus wrap members are made of a thermoplastic elastomer (TPE) material.

16. A binding as defined in claim 10, wherein said first side member is Y-shaped, the tops of the arms of the Y of said first side member being secured to said base member at a first location near said left side and said front side of said base member and a second location near said left side of said base member and intermediate said front and back sides of said base member, and wherein said second side member is Y-shaped, the tops of the arms of the Y of said second side member being secured to said base member at a first location near said right side and said front side of said base member and a second location near said right side of said base member and intermediate said front and back sides of said base member.

17. A binding as defined in claim 16, wherein said arms of said Y's of said first and second side members are secured to said base member in a pivotable manner to allow said first and second side members to better conform to the foot of a wearer.

18. A binding as defined in claim 10, wherein said first calcaneus wrap member is L-shaped, the top of the leg of the L of said first calcaneus wrap member being secured to said base member at a location near said left side and said rear side of said base member with the leg of the L oriented generally upward from said base member and the base of the L oriented generally toward said front side of said base member at said left side thereof, and wherein said second calcaneus wrap member is L-shaped, the top of the leg of the L of said second calcaneus wrap member being secured to said base member at a location near said right side and said rear side of said base member with the leg of the L oriented generally upward from said base member and the base of the L oriented generally toward said front side of said base member at said right side thereof.

19. A binding as defined in claim 18, wherein said tops of said legs of said first and second calcaneus wrap members are secured to said base member in a pivotable manner to allow said first and second calcaneus wrap members to better conform to the foot of a wearer.

20. A binding as defined in claim 1, additionally comprising:

a heel pad for placement on top of said snowshoe; and a rear claw member for placement on the bottom of said snowshoe, said heel pad and said rear claw member being secured together.

21. A binding as defined in claim 1, additionally comprising:

an Achilles strap member, said first and second fastening members passing therethrough such that said Achilles strap member serves to retain said first and second fastening members therein in close proximity to each other, said Achilles strap member having a loop extending therefrom which may be used to facilitate installation of said binding.

22. A binding for mounting on a snowshoe for releasably retaining the foot of a wearer therein, said binding comprising:

a base member which may be mounted on the snowshoe, said base member being arranged and configured to support at least a forward portion of the foot of a wearer, said base member having a left side and a right side and a front side and a rear side;

a toe stop which extends upward vertically from the front side of said base member;

a first strap member having a first end secured to said base member at a location adjacent said left side and said rear side of said base member, said first strap member also having a second end;

a first calcaneus wrap member secured to said base member at a location adjacent said left side and said rear side of said base member, said first end of said first strap member being location intermediate said first calcaneus wrap member and said base member at the point at which said first calcaneus wrap member and said first end of said first strap member are secured to said base member;

a second strap member having a first end secured to said base member at a location adjacent said left side of said base member and intermediate said front and back sides of said base member, said second strap member also having a second end; a first side member secured to said base member at a location adjacent said left side of said base member and intermediate said front and back sides of said base member, said first end of said second strap member being located intermediate said first side member and said base member at the point at which said first side member and said first end of said second strap member are secured to said base member;

a first buckle secured to said second end of one of said first and second strap members, said first buckle being operable to engage said second end of the other of said first and second strap members in a manner allowing for a variable adjustment of the length of the portion of said other of said first and second strap members between said first end of said other of said first and second strap members and said first buckle;

a third strap member having a first end secured to said base member at a location adjacent said right side and said rear side of said base member, said third strap member also having a second end;

a second calcaneus wrap member secured to said base member at a location adjacent said right side and said rear side of said base member, said first end of said third strap member being located intermediate said second calcaneus wrap member and said base member at the point at which said second calcaneus wrap member and said first end of said third strap member are secured to said base member;

a fourth strap member having a first end secured to said base member at a location adjacent said right side of said base member and intermediate said front and back sides of said base member, said fourth strap member also having a second end;

a second side member secured to said base member at a location adjacent said right side of said base member and intermediate said front and back sides of said base member, said first end of said fourth strap member being located intermediate said second side member and said base member at the point at which said second side member and said first end of said fourth strap member are secured to said base member;

a second buckle secured to said second end of one of said third and fourth strap members, said second buckle being operable to engage said second end of the other of said third and fourth strap members in a manner allowing for a variable adjustment of the length of the portion of said other of said third and fourth strap members between said first end of said other of said third and fourth strap members and said second buckle; and an Achilles strap member, said first and third strap members passing therethrough such that said Achilles strap member serves to retain said first and third strap members therein in close proximity to each other.

23. A binding for mounting on a snowshoe for releasably retaining the foot of a wearer therein, said binding comprising:

a base member which may be mounted on the snowshoe, said base member being arranged and configured to support at least a forward portion of the foot of a wearer, said base member having a left side and a right side and a front side and a rear side;

a first fastening member having a first end connected to said base member, said first fastening member having a second end connected to said base member forwardly of said first end, said first fastening member including a looped forward section interconnected with a first buckle arrangement for adjusting the length of the first fastening member; and a second fastening member having a first end connected to said base member, said second fastening member having a second end connected to said base member forwardly of said first end, said second fastening member including a looped forward section interconnected with a second buckle arrangement for adjusting the length of the second fastening member;

wherein said first and second fastening members wrap around the calcaneus of the foot of a wearer and cross each other over the forward portion of the foot of a wearer, wherein the looped forward sections of the first and second fastening members are threaded through each other where the first and second fastening members cross each other.

24. A snow shoe binding, comprising:

a base member adapted for engagement with the snow shoe;

left and right calcaneus wrap members interconnected with and extending from the base member;

a first adjustable length strap member interconnected with and extending from a leftward side defined by the base member at a location forwardly of the left calcaneus wrap member; and a second adjustable length strap member interconnected with and extending from a rightward side defined by the base member;

wherein the first strap member and the second strap member cross each other, wherein the first strap member is adapted to wrap about the right calcaneus area of the foot of a wearer and engages the right calcaneus wrap member, and wherein the second strap member is adapted to wrap about the left calcaneus area of the foot of a wearer and engages the left calcaneus wrap member.

25. The binding of claim 24, wherein a first strap member defines a first end interconnected with the base member and a second end interconnected with the base member at a location rearwardly of the first end, and wherein the second strap member defines a first end interconnected with the base member and a second end interconnected with the base member at a location rearwardly of the first end.

26. The binding of claim 25, wherein the second end of the first strap member is interconnected with the base member at a location common with the connection of the left calcaneus wrap member with the base member, and wherein the second end of the second strap member is interconnected with the base member at a location common with the connection of the right calcaneus wrap member to the base member.

27. The binding of claim 25, wherein the first end of each of the first and second strap members is interconnected with the base member by means of a looping strap member, wherein each looping strap member defines a pair of ends interconnected with the base member, and a slip joint interposed between each looping strap member and the corresponding first end of the first and second strap members.

28. The binding of claim 25, wherein each calcaneus wrap member includes a retainer loop arrangement through which the first and second strap members extend for guiding and retaining the first and second strap members relative to the calcaneus wrap members.

29. The binding of claim 24, further comprising a pair of front side members interconnected with the base member, wherein each strap member is located outwardly of one of the front side members.

30. The binding of claim 29, wherein each front side member includes a pair of leg members spaced apart from each other in a forward-rearward direction, wherein each leg member is pivotably interconnected with the base member.

31. The binding of claim 30, wherein each of the first and second strap members defines a first end located outwardly of one of the front side members, and is interconnected with the base member by means of a looping strap member having a pair of ends and a slip joint interposed between each looping strap member and the corresponding first end of the first and second strap members, wherein the ends of each looping strap member are pivotably interconnected with the base member at common locations to the pivotable interconnection of the first and second leg members of the front side members.

* * * * *